US008106739B2

(12) United States Patent
Shpiro

(10) Patent No.: US 8,106,739 B2
(45) Date of Patent: Jan. 31, 2012

(54) MAGNETIC INDUCTION DEVICES AND METHODS FOR PRODUCING THEM

(75) Inventor: Zeev Shpiro, Tel Aviv (IL)

(73) Assignee: Advanced Magnetic Solutions United, Wanchai (HK)

( * ) Notice: Subject to any disclaimer, the term of this patent is extended or adjusted under 35 U.S.C. 154(b) by 111 days.

(21) Appl. No.: 12/663,844

(22) PCT Filed: Jun. 12, 2008

(86) PCT No.: PCT/IL2008/000804

§ 371 (c)(1),
(2), (4) Date: Dec. 10, 2009

(87) PCT Pub. No.: WO2008/152641

PCT Pub. Date: Dec. 18, 2008

(65) Prior Publication Data

US 2010/0188183 A1 Jul. 29, 2010

Related U.S. Application Data

(60) Provisional application No. 60/943,313, filed on Jun. 12, 2007.

(51) Int. Cl.
*H01F 5/00* (2006.01)
*H01F 27/28* (2006.01)
*H01F 7/06* (2006.01)

(52) U.S. Cl. ..... 336/223; 336/229; 336/232; 29/602.1

(58) Field of Classification Search ..... 336/200, 336/223, 232, 83

See application file for complete search history.

(56) References Cited

U.S. PATENT DOCUMENTS

| | | | |
|---|---|---|---|
| 1,994,767 | A | 3/1935 | Heintz |
| 3,123,787 | A | 3/1964 | Shifrin |
| 3,149,296 | A | 9/1964 | Cox |
| 3,336,662 | A | 8/1967 | Howland et al. |
| 3,816,907 | A | 6/1974 | Small |
| 3,874,075 | A | 4/1975 | Lohse |
| 4,503,605 | A | 3/1985 | Buckley |
| 4,663,603 | A | 5/1987 | Van Riemsdijk et al. |
| 4,837,129 | A | 6/1989 | Frisch |
| 5,497,137 | A | 3/1996 | Fujiki |
| 5,546,065 | A | 8/1996 | Vinciarelli et al. |
| 5,717,552 | A | 2/1998 | Varian |
| 5,793,272 | A | 8/1998 | Burghartz |
| 5,834,825 | A | 11/1998 | Imai |

(Continued)

FOREIGN PATENT DOCUMENTS

| | | |
|---|---|---|
| EP | 1347473 | 9/2003 |

(Continued)

OTHER PUBLICATIONS

Ed Bloom, "Planer Power Magnetics" Magnetics Business & Technology, Aug. 2002, 3pgs.

(Continued)

*Primary Examiner* — Anh Mai
(74) *Attorney, Agent, or Firm* — Mark M. Friedman

(57) ABSTRACT

A magnetic induction device (MID) is disclosed. The MID includes a core, and at least one first winding including at least one conductive strip deposited on the core and including at least two turns which are substantially simultaneously shaped. Related apparatus and methods are also disclosed.

15 Claims, 19 Drawing Sheets

U.S. PATENT DOCUMENTS

| | | | | |
|---|---|---|---|---|
| 5,847,634 | A * | 12/1998 | Korenivski et al. | 336/200 |
| 5,877,666 | A * | 3/1999 | Johnson, Jr. et al. | 336/180 |
| 5,877,667 | A | 3/1999 | Wollesen | |
| 5,886,589 | A | 3/1999 | Mourant | |
| 6,008,102 | A | 12/1999 | Alford et al. | |
| 6,114,097 | A | 9/2000 | Malba et al. | |
| 6,163,234 | A | 12/2000 | Kossives | |
| 6,165,340 | A | 12/2000 | Andrus et al. | |
| 6,215,387 | B1 | 4/2001 | Person et al. | |
| 6,246,311 | B1 | 6/2001 | Finnemore et al. | |
| 6,255,714 | B1 | 7/2001 | Kossives et al. | |
| 6,285,273 | B1 | 9/2001 | Morikawa | |
| 6,351,204 | B1 | 2/2002 | Yamasawa et al. | |
| 6,417,754 | B1 | 7/2002 | Bernhardi et al. | |
| 6,445,271 | B1 | 9/2002 | Johnson | |
| 6,498,557 | B2 | 12/2002 | Johnson | |
| 6,535,094 | B2 | 3/2003 | Murata et al. | |
| 6,642,827 | B1 | 11/2003 | McWilliams et al. | |
| 6,686,824 | B1 * | 2/2004 | Yamamoto | 336/200 |
| 6,696,227 | B2 | 2/2004 | Hsu et al. | |
| 6,696,744 | B2 | 2/2004 | Feygenson et al. | |
| 6,768,410 | B1 | 7/2004 | Yazaki et al. | |
| 6,788,164 | B2 | 9/2004 | Maekawa et al. | |
| 6,801,114 | B2 | 10/2004 | Yang et al. | |
| 6,819,199 | B2 | 11/2004 | Burns et al. | |
| 6,831,544 | B2 | 12/2004 | Patel | |
| 6,852,605 | B2 | 2/2005 | Ng et al. | |
| 6,938,325 | B2 | 9/2005 | Tanieltan | |
| 6,946,945 | B2 | 9/2005 | Sata et al. | |
| 7,107,668 | B2 | 9/2006 | Nishi | |
| 7,158,004 | B2 | 1/2007 | Ahn et al. | |
| 7,205,876 | B2 | 4/2007 | Lee et al. | |
| 7,304,558 | B1 * | 12/2007 | Pleskach et al. | 336/200 |
| 2006/0152322 | A1 * | 7/2006 | Whittaker et al. | 336/200 |
| 2007/0030107 | A1 | 2/2007 | Waffenschmidt et al. | |
| 2007/0159287 | A1 | 7/2007 | Jung et al. | |

FOREIGN PATENT DOCUMENTS

| | | |
|---|---|---|
| JP | 60098605 | 6/1985 |
| JP | 61187205 | 8/1986 |
| WO | WO2005072109 | 8/2005 |
| WO | WO2006064499 | 6/2006 |
| WO | WO2007038309 | 4/2007 |

OTHER PUBLICATIONS

Yoon et al, "Novel and high-yield fabrication of electroplated 3D micro-coils for MEMS and microelectronics", SPIE Conference on Micromachining and Microfabrication Process Technology IV, Santa Clara, California, Sep. 1998, SPIE vol. 3511, pp. 233-240.

Jolic at al, "Fabrication of three-dimensional inductor coil using excimer laser micromachining", Journal of Micromechanics and Microengineering, 13 (2003), pp. 782-789.

Vincent Melba et al, "Laser-Lathe Lithography—a Novel Method for Manufacturing Nuclear Magnetic Resonance Microcoils", Biomedical Microdevices 5:1, 21-27, 2003.

Rassel et al, "Fabrication and Characterization of a Solenoid-Type Microtransformer", IEEE Transactions on Magnetics, vol. 39, No. 1, Jan. 2003, pp. 553-558.

Siewert et al, "Photolithographic structuring of a thin metal film coil on a Zerodur cylinder", Surface & Coatings Technology 200 (2005) 1061-1064.

Ermolov et al, "Microsystem Technologies for Mobile Communication Products", SMTA International, Sep. 30, 2001.

John A. Rogers, "Techniques and Applications for Non-Planar Lithography", Materials Research Society Symp. Proc. vol. 739, 2003, pp. H1.2.1-H1.2.8.

International Search Report and the Written Opinion for PCT patent application PCT/IL2008/000804, filed Jun. 12, 2008.

Bethany Halford, "Materials Potpourri", Chemical & Engineering News (ISSN 0009-2347): Jan. 3, 2005.

Jie Wu et al, "Powering efficiency of inductive links with inlaid electroplated microcoils", Journal of Micromechanics and Microengineering, 14 (2004) 576-586.

* cited by examiner

MAGNETIC INDUCTION DEVICES AND METHODS FOR PRODUCING THEM

The present application is a 35 USC §371 application of PCT Patent Application PCT/IL2008/000804, filed on 12 Jun. 2008 and entitled "MAGNETIC INDUCTION DEVICES AND METHODS FOR PRODUCING THEM", which was published on 18 Dec. 2008 in the English language with International Publication Number WO 2008/152641, and which claims priority from U.S. Provisional Patent Application Ser. No. 60/943,313, filed 12 Jun. 2007, the disclosure of which is hereby incorporated herein by reference.

FIELD OF THE INVENTION

The present invention generally relates to magnetic induction devices and to methods for producing magnetic induction devices.

BACKGROUND OF THE INVENTION

Magnetic induction devices (MIDs), such as transformers, inductors, loop antennas, Baluns (Balun—Balanced-Unbalanced), etc., are used in many applications, such as communication network applications, power circuit applications, test equipment, and radio-frequency (RF) applications.

In addition to traditional techniques of wire winding, there is a continuous search for new technologies that may eliminate the need for actual winding of wires. Some new techniques use integrated circuit (IC) fabrication technologies or printed circuit board (PCB) fabrication technologies for producing planar structures or multilayer structures that are intended to replace wire windings.

MIDs produced by IC fabrication technologies typically include multiple stacked layers. The layers are typically thin and the resultant MIDs are usually too small for many applications. Additionally, MIDs produced by IC fabrication technologies typically have air cores which limit applicability of such MIDs for various applications, such as for low-frequency communication applications and power applications.

Some IC fabrication technologies are focused on constructing thick stacked layers. One advantage of using such thick layers is the ability to produce MIDs with magnetic cores rather than with air cores. However, the overall size of MIDs produced using such thick layers is still small for many applications.

Planar transformers are typically produced using PCB or IC fabrication technologies. In such fabrication technologies, a planar spiral of conductive material is produced in one or more layers of a set of stacked layers, and in some cases, a spiral of one layer is connected to a spiral of a neighbor layer to provide a winding.

Some aspects of technologies and material that may be useful in understanding the present invention are described in the following publications:

an article entitled "Novel and high-yield fabrication of electroplated 3D micro-coils for MEMS and microelectronics", by Yoon et al, SPIE Conference on Micromachining and Microfabrication Process Technology IV, Santa Clara, Calif., September 1998, SPIE Vol. 3511, pages 233-240;

an article entitled "Fabrication of three-dimensional inductor coil using excimer laser micromachining", by Jolic et al, in *Journal of Micromechanics and Microengineering,* 13 (2003), pages 782-789;

an article entitled "Fabrication and Characterization of a Solenoid-Type Microtransformer", by Rassel et al, in *IEEE Transactions on Magnetics*, Vol. 39, No. 1, January 2003, pages 553-558;

an article entitled "Photolithographic structuring of a thin metal film coil on a Zerodur cylinder", by Siewert et al, Surface & Coating Technology 200 (2005) 1061-1064;

an article entitled "Laser-Lathe Lithography—a Novel Method for manufacturing Nuclear magnetics Resonance Microcoils", by Vincet Malba et al, Biomedical Microdevices 5:1, 21-27, 2003;

an article entitled "Powering efficiency of inductive links with inlaid electroplated microcoils", by Jie Wu et al, in *Journal of Micromechanics and Microengineering,* 14 (2004) 576-586;

Published PCT application 2006/064499 of Axelrod et al; and the following U.S. patents:

U.S. Pat. No. 1,994,767 to Heintz;
U.S. Pat. No. 3,123,787 to Shifrin;
U.S. Pat. No. 3,874,075 to Lohse;
U.S. Pat. No. 5,793,272 to Burghartz et al;
U.S. Pat. No. 5,834,825 to Imai;
U.S. Pat. No. 6,008,102 to Alford et al;
U.S. Pat. No. 6,351,204 to Yamasawa et al;
U.S. Pat. No. 6,417,754 to Bernhardt et al;
U.S. Pat. Nos. 6,445,271 and 6,498,557 to Johnson;
U.S. Pat. No. 6,642,827 to McWilliams et al;
U.S. Pat. No. 6,831,544 to Patel et al; and
U.S. Pat. No. 6,852,605 to Ng et al.

SUMMARY OF THE INVENTION

The present invention, in certain embodiments thereof, seeks to provide improved magnetic induction devices (MIDs) and improved methods for producing MIDs.

The term "magnetic induction device" (MID) is used throughout the present specification and claims to include a device that makes use of the principle of electromagnetic induction and is typically used in electrical and magnetic circuitry which is employed for various applications. Examples, which are not meant to be limiting, of a MID include at least one of the following: a transformer; a Balun (Balun—Balanced-Unbalanced); an electrical power divider; an electrical power splitter; an electrical power combiner; a common-mode (CM) choke; a mixing device based on magnetic induction components; a modulator; a loop antenna; and an inductor.

Rather than starting MID production from layers which are used to produce MID windings as in conventional integrated circuit (IC) and printed circuit board (PCB) fabrication technologies that are employed for MID production, the present invention, in certain embodiments thereof, starts from a MID core as a basis for MID production, and then offers novel MID winding structures and methods for producing MID windings which encircle one or more core sections.

The present invention, in certain embodiments thereof, enables production of MIDs having magnetic cores, cores comprising at least one insulating material, and air cores which comprise covers for supporting windings. The MIDs and the cores may be produced with core dimensions and MID dimensions which are not limited in size as MIDs produced by using IC and/or PCB fabrication technologies.

There is thus provided in accordance with an embodiment of the present invention a magnetic induction device (MID) including a core, and at least one first winding including at least one conductive strip deposited on the core and including at least two turns which are substantially simultaneously shaped.

The core may include at least one of the following: a magnetic core, a core including at least one insulating material, and an air core including a cover for supporting the at least one first winding.

The at least two turns may be substantially simultaneously shaped by selectively etching a layer obtained using a photolithography technique.

Alternatively, the at least two turns may be substantially simultaneously shaped by constructing the at least two turns on the core using a sputter deposition process on a mask which covers the core and has at least one pattern for the at least one first winding which includes the at least two turns.

The core may include a core having a structure which defines a closed path for magnetic flux.

The structure may include a bar frame including at least one substantially straight bar, and the at least one conductive strip may be deposited on the at least one substantially straight bar.

In a case where the core includes a core having a structure which defines a closed path for magnetic flux, the at least one first winding may have a variable width along at least one of the at least two turns.

The MID may also include a structurally-distinguishable mark constructed on the core for enabling identification of MID terminals.

The at least one first winding may include at least two windings including at least two pairs of terminations enabling the MID to operate as a transformer.

The MID may also include a non-conformal dielectric layer which coats the core and the at least one conductive strip.

The non-conformal dielectric layer may include a plurality of layers.

The non-conformal layer may be thicker on a core surface that is not covered by the at least one conductive strip than on a core surface that is covered by the at least one conductive strip so as to obtain a substantially flattened surface area of the non-conformal layer.

The non-conformal dielectric layer may have through-holes which match terminations of the at least one first winding.

The through-holes may be at least partially filled with a conductive material for providing winding terminations.

The MID may also include an insulation layer coating the core and the at least one first winding, and at least one second winding above at least a portion of the insulation layer.

Each of the at least one first winding and the at least one second winding may include at least one pair of terminations enabling the MID to operate as a transformer.

The MID may also include a conductive layer electrically isolated from the at least one first winding and from the at least one second winding and selectively etched/constructed to leave an uncoated gap so as to create an electrically-conductive cover (ECC) which does not define a closed conductive path perpendicular to a direction of propagation of magnetic flux in the core, the ECC being placed either in a layer between the at least one first winding and the at least one second winding, or above the at least one second winding.

The MID may further include a dielectric layer which covers the at least one first winding and the at least one second winding and has through-holes which match terminations of the at least one first winding and of the at least one second winding, the through-holes being at least partially filled with a conductive material for providing winding terminations.

The MID may be used as a surface-mount device (SMD).

There is also provided in accordance with an embodiment of the present invention a MID including a core, at least one first winding deposited on the core and including at least one turn, and a non-conformal dielectric layer which coats the core and the at least one first winding.

Further in accordance with an embodiment of the present invention there is provided a MID including a core, a structurally-distinguishable mark constructed on the core for enabling identification of MID terminals, and at least one first winding deposited on the core and including at least one turn.

The structurally-distinguishable mark may include at least one of the following: a protrusion protruding off the core, a groove in the core, an indentation in the core, a rounded corner in a substantially rectangular shaped core, and a rounded corner in a substantially polygonal shaped core.

The core may include a core having a structure which defines a closed path for magnetic flux.

The structure may include a bar frame including at least one substantially straight bar, and the at least one first winding may be deposited on the at least one substantially straight bar.

Still further in accordance with an embodiment of the present invention there is provided a MID including a core, at least one first winding deposited on the core and including at least one turn having conductive terminations, and a dielectric layer which coats the core and the at least one first winding, the dielectric layer having through-holes matching the terminations and at least partially filled with a conductive material for providing winding terminations.

There is also provided in accordance with an embodiment of the present invention a method for producing a MID, the method including providing a core, and depositing at least one first winding which includes at least one conductive strip which includes at least two turns on the core, the depositing including substantially simultaneously shaping the at least two turns.

The substantially simultaneously shaping may include covering the core with a mask having at least one pattern for the at least one first winding which includes the at least two turns, the mask covering portions of the core surface which are not to be coated with a conductive layer, and using a thin-film deposition technique for depositing a first conductive layer on portions of the core surface which are to be coated with a conductive layer thereby substantially simultaneously forming the at least two turns of the at least one first winding.

The using may include employing a sputter deposition process for depositing the first conductive layer.

The substantially simultaneously shaping may alternatively include coating the core with a conductive layer, coating the conductive layer with photo-resist material, covering at least two facets of the core with a mask having at least one pattern for at least one section of at least one first winding which includes at least two turns, illuminating the core, through the mask, by multiple light flashes, and selectively etching portions of the conductive layer, thereby producing the at least two turns of the at least one first winding.

The mask may include at least two three-dimensional mask elements, or at least two two-dimensional mask elements.

Further in accordance with an embodiment of the present invention there is provided a method for producing a MID, the method including providing a core, depositing at least one first winding which includes at least one turn on the core, and coating the core and the at least one first winding with a non-conformal dielectric layer coating which is thicker on a core surface that is not covered by the at least one turn than on a core surface that is covered by the at least one turn.

The non-conformal dielectric layer may include a plurality of layers.

Still further in accordance with an embodiment of the present invention there is provided a method for producing a MID, the method including providing a core, constructing a structurally-distinguishable mark on the core for enabling identification of MID terminals, and depositing at least one first winding which includes at least one turn on the core.

There is also provided in accordance with an embodiment of the present invention a method for producing a MID, the method including providing a core, depositing at least one first winding which includes at least one turn having conductive terminations on the core, coating the core and the at least one first winding with a dielectric layer, drilling, in the dielectric layer, through-holes which match the terminations, and at least partially filling the through-holes with a conductive material for providing winding terminations.

BRIEF DESCRIPTION OF THE DRAWINGS

The present invention will be understood and appreciated more fully from the following detailed description, taken in conjunction with the drawings in which.

DETAILED DESCRIPTION OF AN EMBODIMENT

Figure 1A:
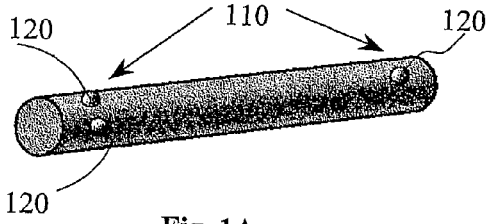
FIGS. 1A-1H together constitute a simplified pictorial illustration of a magnetic induction device (MID) comprising a cylindrical inductor in various production stages in accordance with an embodiment of the present invention.
Figure 1B:
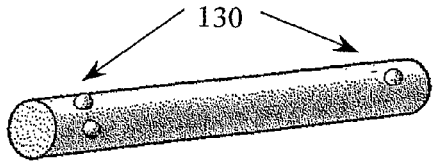
Figure 1C:
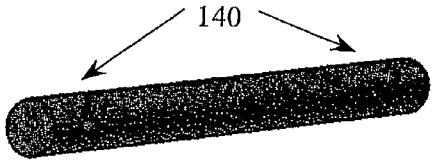
Figure 1D:
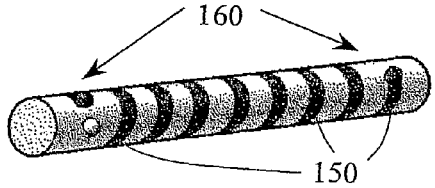
Figure 1E:
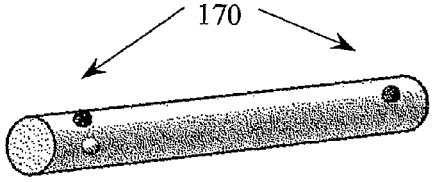
Figure 1F:
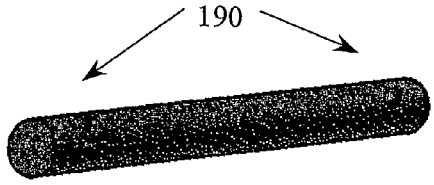
Figure 1G:
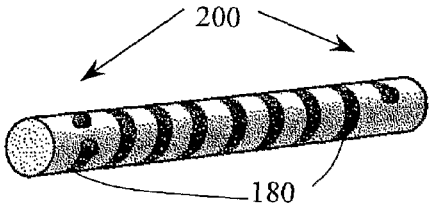
Figure 1H:
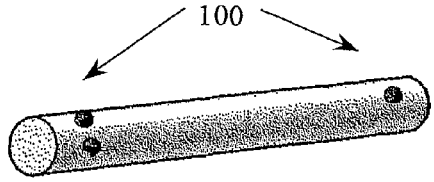
Figure 1I:
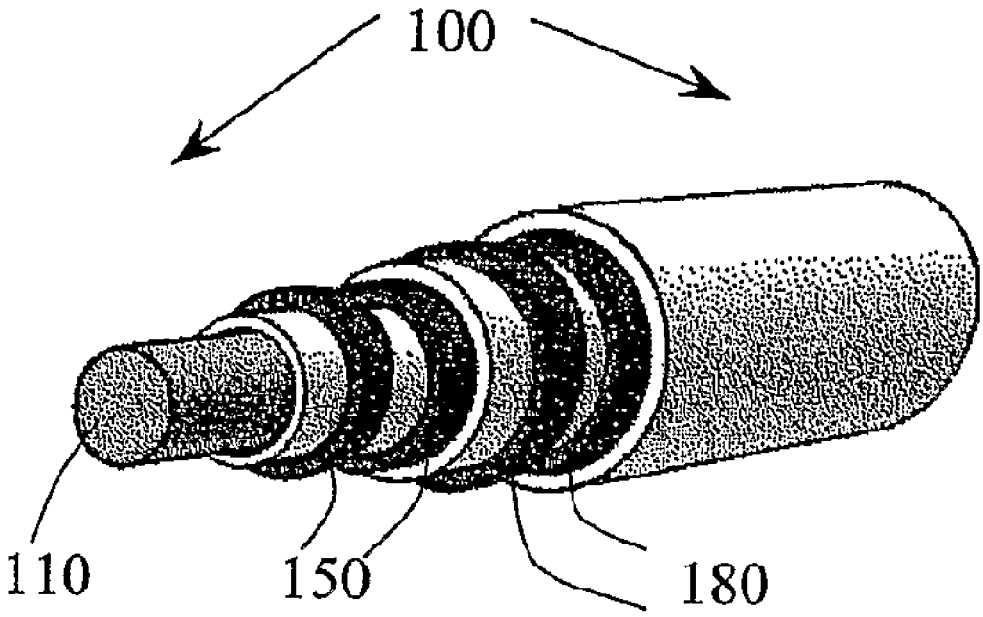
FIG. 1I is a simplified, un-scaled perspective view of the MID of FIG. 1H with layer cuts showing various layers around MID core.

Reference is now made to FIGS. 1A-1H, which together constitute a simplified pictorial illustration of a magnetic induction device (MID) 100 comprising a cylindrical inductor in various production stages in accordance with an embodiment of the present invention, and to FIG. 1I which is a simplified, un-scaled perspective view of the MID 100 with layer cuts showing various layers around MID core.

FIG. 1A depicts a cylindrical core 110 which is used as a basis for producing the MID 100. The core 110 may comprise at least one of the following: a magnetic core; a core comprising at least one insulating material; and an air core comprising a cover for supporting at least one winding. It is appreciated that the cover of the air core may, by way of a non-limiting example, be disposable, so that the cover may, for example, be taken out or consumed by a chemical process after the at least one winding is produced.

The core 110 may have protrusions/pins 120 which may be used as conductive terminations of the MID 100, as described herein below.

The core 110 may optionally be coated with an insulation material, such as Parylene, as is well known in the art, to provide an insulated core 130 as shown in FIG. 1B. Then, the following steps may be performed to produce the MID 100:

(1) Coating substantially all surfaces of the Parylene coated core 130 with a conductive layer, such as a copper layer, to obtain a copper coated core 140 which is depicted in FIG. 1C, where the coating of the core 130 with the copper layer comprises:

(1.1) Optionally coating with a plateable resin (such as ABS);

(1.2) Activating the resin surface;

(1.3) Electroless plating with a thin conductive layer (such as nickel); and (1.4) Electroplating with the copper layer;

(2) Applying photolithography techniques to substantially simultaneously etch (substantially simultaneously means that multiple locations are being exposed to light at substantially the same time, and then multiple locations are etched at substantially the same time) at least a first winding strip 150 on the copper coated core 140 to provide a device 160 with winding as shown in FIG. 1D. By way of a non-limiting example, application of the photolithography techniques comprises the following:

(2.1) Coating substantially all surfaces of the copper coated core 140 with a photo-resist material, for example which is not meant to be limiting, by dipping the copper coated core 140 in a photo-resist liquid;

(2.2) Preparing a mask which may comprise multiple partial masks for covering all surfaces of the copper coated core 140, where the mask exposes strips of the copper layer which are ultimately intended to be removed from the copper layer (or alternatively intended to be maintained) in order to form the at least a first winding strip 150;

(2.3) Exposing the mask which covers the copper coated core 140 to ultra-violet (UV) light in multiple exposures (or alternatively from multiple sources);

(2.4) Developing the photo-resist material;

(2.5) Etching areas of the copper layer which were exposed (or alternatively were not exposed) to the UV light to form the at least a first winding strip 150 and terminations; and (2.6) Optionally, removing any remaining photo-resist material;

(3) Coating the device 160 after the at least a first winding strip 150 and the terminations are produced with an insulation layer, such as Parylene, except for two pins 120 so as to provide a coated device 170 as shown in FIG. 1E, where the two pins 120, which remain coated with the copper layer and thus conductive, may be employed as start and end points of the at least a first winding strip 150; and (4) Repeating steps (1)-(3) above in order to form at least a second winding strip 180 in a second copper layer, where FIG. 1F shows a device 190 obtained after step (1) including all sub-steps thereof is repeated on the coated device 170, FIG. 1G shows a device 200 having the at least a second winding strip 180 obtained after step (2) including all sub-steps thereof is repeated on the coated device 190, and FIG. 1H shows the MID 100 obtained after step (3) is repeated on the device 200.

It is appreciated that steps 1.1-1.3 may alternatively be replaced by a physical deposition technique, such as sputtering of copper.

It is appreciated that solutions for coating plastic materials and non-metallic materials with a conductive layer, such as a copper layer, are well known in the art and available, for example, from Cybershield of Lufkin, Tex., USA as described at the web site www.cybershieldinc.com.

It is further appreciated that step (2) and all sub-steps thereof may alternatively be performed on the thin nickel layer produced in step (1.3) in order to directly construct the at least a first winding strip 150 on the nickel layer and then to electroplate the first winding strip 150 with a copper layer.

Still further, it is appreciated that by leaving one of the two pins 120 conductive before steps (1)-(3) are repeated, the at least a first winding strip 150 is electrically connected to the at least a second winding strip 180 thus providing the MID 100 which comprises a two-winding (in two layers) inductor.

FIG. 1I shows a simplified, un-scaled perspective view of the MID 100 with layer cuts showing the various layers around the core 110.

It is appreciated that the production steps (1)-(3) or (1)-(4) mentioned above may be applied on a variety of core shapes and core materials.

Figure 2A:
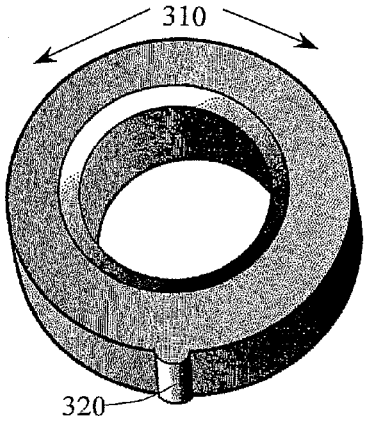
FIGS. 2A-2F together constitute a simplified pictorial illustration of another MID comprising a toroidal inductor in various production stages in accordance with an embodiment of the present invention.
Figure 2B:
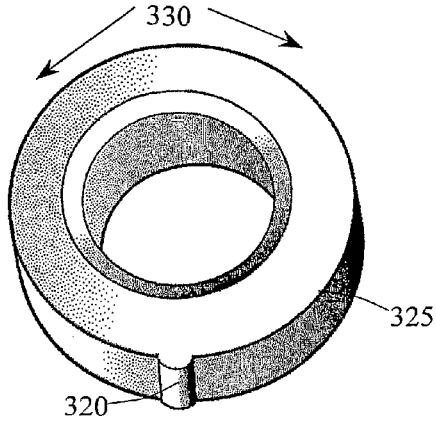
Figure 2C:
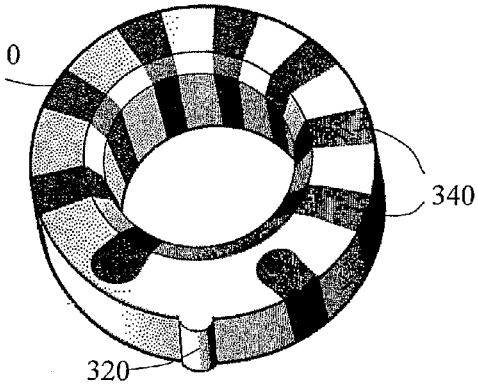
Figure 2D:
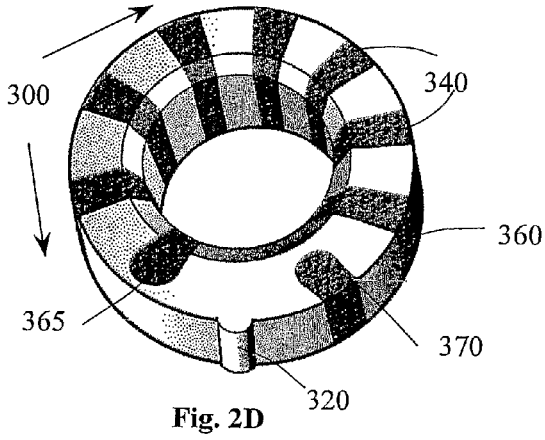
Figure 2E:
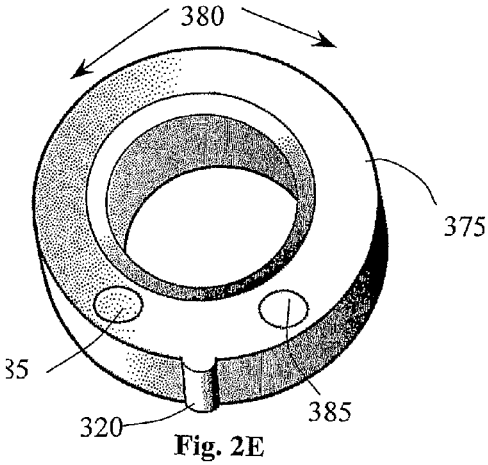
Figure 2F:
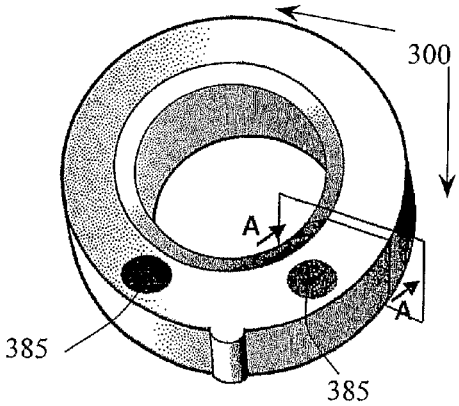
Figure 2G:
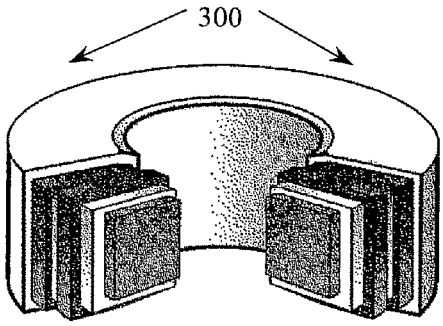
FIG. 2G is a simplified, un-scaled perspective view of the MID of FIG. 2F with layer cuts showing various layers around MID core.
Figure 2H:
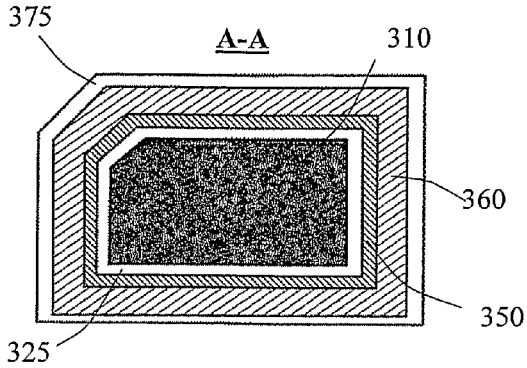
FIG. 2H is a simplified pictorial illustration of a cross-section view of the MID of FIG. 2F.

Reference is now made to FIGS. 2A-2F, which together constitute a simplified pictorial illustration of another MID 300 comprising a toroidal inductor in various production stages in accordance with an embodiment of the present invention, to FIG. 2G which is a simplified, un-scaled perspective view of the MID 300 with layer cuts showing various layers around MID core, and to FIG. 2H which is a simplified pictorial illustration of a cross-section view of the MID 300.

The MID 300 comprises, for example, a toroidal core 310 which comprises, by way of a non-limiting example, a ferrite core. The toroidal core 310 provides a structure which defines a closed path for magnetic flux.

The core 310 may comprise a structurally-distinguishable mark 320 for enabling identification of MD terminals as described below. The structurally-distinguishable mark 320 is constructed as part of the core. By way of a non-limiting example, the structurally-distinguishable mark 320 comprises at least one of the following: a protrusion protruding off the core; a groove in the core; and an indentation in the core. In the embodiment of FIGS. 2A-2H the structurally-distinguishable mark 320 is shown to comprise, by way of a non-limiting example, a protrusion which comprises a rib.

It is appreciated that additional or alternative types of structurally-distinguishable marks may be used depending on core shape. For example, in a MID having a substantially rectangular shaped core, a structurally-distinguishable mark may comprise one or more rounded corners of the substantially rectangular shaped core, and in a MID having a substantially polygonal shaped core, a structurally-distinguishable mark may comprise one or more rounded corners of the substantially polygonal shaped core.

The toroid core 310 is coated with a dielectric layer 325 to provide a core 330 as shown in FIG. 2B. It is appreciated that coating with the dielectric layer 325 is optional in a case where the core 310 is made of a dielectric material.

The core 330 is then prepared for depositing a winding, and at least one first winding 340 is then deposited on the core 330. The at least one first winding 340 may be deposited on the core by using a physical deposition technique, such as sputtering which is a well known process. The at least one first winding 340 comprises at least two turns, and the at least two turns are substantially simultaneously shaped. Substantially simultaneously shaping the at least two turns is enabled by constructing the at least two turns in multiple locations at substantially the same time using a three-dimensional mask as described below with reference to FIG. 7 and a jig as described below with reference to FIG. 8 in the sputtering process.

The at least one first winding 340 may comprise the following: an electroless-plated strip 350 of a first conductive material; and an electroplated strip 360 of a second conductive material. The electroplated strip 360 is deposited onto the electroless-plated strip 350. Electroplating techniques are well known to persons of skill in the art. FIG. 2C shows the electroless-plated strip 350 of the at least one first winding 340, and FIG. 2D shows the electroplated strip 360 of the at least one first winding 340.

It is appreciated that the at least one first winding 340 may have a variable width along at least one of the at least two turns as shown in FIG. 2D. The variable width along the at least one of the at least two turns may provide better electrical characteristics (e.g., lower resistance) of the at least one of the at least two turns. For example, if the at least one first winding 340 includes multiple turns, substantially equal distances between adjacent portions of the turns may be maintained while varying the width along each turn so that, for example, a width of a portion of a turn on an outer surface of the core 330 is greater than a width of a portion of the turn on an inner surface of the core 330.

The first conductive material and the second conductive material may comprise different materials. For example, which is not meant to be limiting, the first conductive material may comprise nickel and the second conductive material may comprise copper. Alternatively, the first conductive material and the second conductive material may comprise identical materials, such as, by way of a non-limiting example, copper.

It is appreciated that the electroplated strip 360 is typically thicker than the electroless-plated strip 350. For example, which is not meant to be limiting, the electroplated strip 360 may be about ten times thicker than the electroless-plated strip 350.

By way of a non-limiting example, in the embodiment of FIGS. 2A-2H the first conductive material, which is constructed using sputtering, comprises copper and the second conductive material also comprises copper, and thus the electroless-plated strip 350 comprise a copper strip and the electroplated strip 360 comprises a copper strip. The copper strip 360 may have, by way of a non-limiting example, a 15-25 micron thickness, and the copper strip 350 may have, by way of a non-limiting example, a 1-3 micron thickness.

It is appreciated that the strips 350 and 360 may alternatively comprise different materials as, for example, in the MID 100 of FIGS. 1A-1I in which an electroless-plated strip comprises nickel and an electroplated strip comprises copper.

Figure 7:
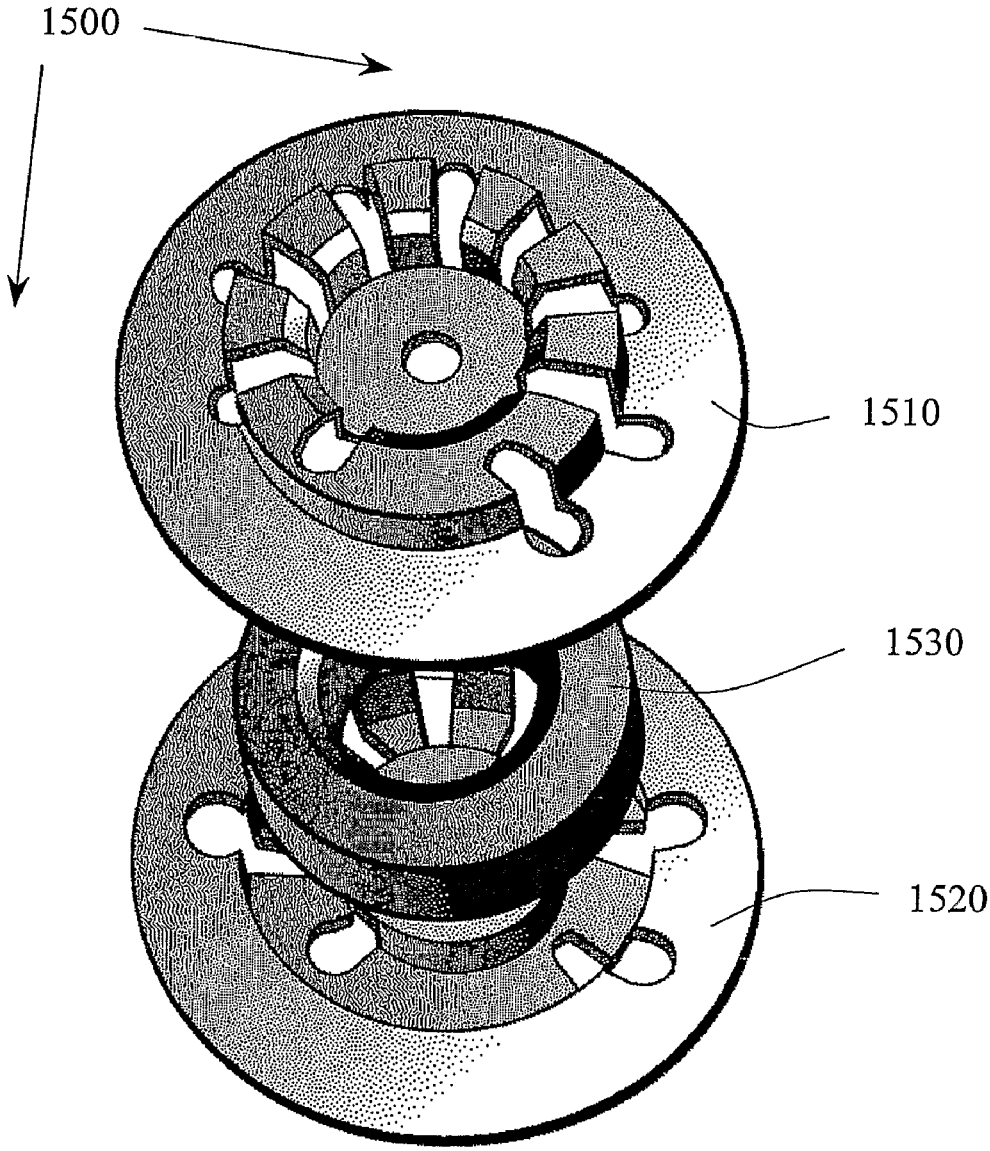
FIG. 7 is a simplified pictorial illustration of a mask usable in production of a MID in accordance with an embodiment of the present invention.

When a physical deposition technique is used for producing the electroless-plated strip 350, the core 330 may be covered with a mask that may comprise two parts as shown in FIG. 7. The mask has at least one pattern for the at least one first winding 340 and it covers portions of the surface of the core 330 which are not to be coated with a conductive layer. The mask is placed on a jig, as shown, for example, in FIG. 8, and a sputter deposition process is then employed on the core 330 covered with the mask to produce the electroless-plated copper strip 350.

The electroplated copper strip 360 is produced by electrolytic deposition of copper on the electroless-plated copper strip 350. The electrolytic deposition may be achieved by multiple techniques, such as applying electrical current between terminations of the strip 350. Electroplating of copper results in accumulation of copper only on the electroless-plated copper strip 350 and thus the electroplated copper strip 360 is deposited onto the electroless-plated strip 350.

By way of a non-limiting example, the at least one first winding 340 shown in FIG. 2D includes eight turns and terminations 365 and 370, and winding direction is clockwise. It is, however, appreciated that the at least one first winding 340 may alternatively include a different number of turns, and winding direction may alternatively be counter-clockwise.

After depositing the at least one first winding 340 on the core 330 a device as shown in FIG. 2D is obtained, which device may be used as a one-layer toroidal inductor. The one-layer toroidal inductor is one type of the MID 300 in accordance with an embodiment of the present invention. The terminations 365 and 370 may be used as terminals for connecting the MID 300 of FIG. 2D to an electric circuit or an electric component (not shown).

The device shown in FIG. 2D may also be coated on all of its surfaces with a dielectric layer 375, which means that both the core 330 and the electroplated copper strip 360 are coated with the dielectric layer 375. By way of a non-limiting example, the dielectric layer 375 comprises a non-conformal dielectric layer. A device 380 as shown in FIG. 2E is obtained upon coating the core 330 and the electroplated copper strip 360 with the non-conformal dielectric layer. It is appreciated that the non-conformal dielectric layer may comprise a plurality of layers.

The non-conformal layer may be thicker on a core surface that is not covered by the electroplated strip 360 than on a core surface that is covered by the electroplated strip 360 so as to obtain a substantially flattened surface area of the non-conformal layer. For example, which is not meant to be limiting, substantial flattening of the surface area of the non-conformal layer may be provided when a sum of a thickness of the electroless-plated strip 350, a thickness of the electroplated strip 360, and a thickness of the non-conformal layer on the core surface that is covered by the electroplated strip 360 is greater than a thickness of the non-conformal layer on the core surface that is not covered by the electroplated strip 360 by about less than half the thickness of the electroplated strip 360.

The dielectric layer 375 has through-holes 385 as shown in FIG. 2E. The through-holes 385 match the terminations 365 and 370 of the at least one first winding 340. The through-holes 385 are at least partially filled with a conductive material, such as silver-epoxy, for providing winding terminations as shown in FIG. 2F. The device of FIG. 2F may be used as a one-layer toroidal inductor with a dielectric layer coating which is another type of the MID 300 in accordance with an embodiment of the present invention. The winding terminations provided by the through-holes 385 which are at least partially filled with the conductive material may be used as terminals for connecting the MID 300 of FIG. 2F to an electric circuit, an electric component, or a Printed Circuit Board (PCB) thus making the MID 300 a Surface-Mount Device (SMD). It is appreciated that depending on the thickness of the dielectric layer 375, in certain cases it may be sufficient to allow the through-holes 385 to be filled only with a soldering paste during an SMT assembly process in order to provide suitable terminations.

It is appreciated that the dielectric layer 375 with the non-conformal layer which is thicker on a core surface that is not covered by the electroplated strip 360 than on a core surface that is covered by the electroplated strip 360 and with the at least partially filled through-holes 385 which match the terminations 365 and 370 may be used with a core having a winding deposited thereon regardless of a way the core is prepared for winding deposition and regardless of a way the winding is deposited on the core.

It is further appreciated that the MIDs 300 shown in FIGS. 2D and 2F may be produced either with or without the structurally-distinguishable mark 320. When the MIDs 300 shown in FIGS. 2D and 2F are produced without the structurally-distinguishable mark 320 it may be difficult, but not impossible, for a user to identify which MID terminal should be used as a "start" terminal and which MID terminal should be used as an "end/finish" terminal. The structurally-distinguishable mark 320 eases identification of the MID terminals and enables unambiguous identification of the "start" and the "end/finish" MID terminals.

The structurally-distinguishable mark 320 enables unambiguous identification of the MID terminals by indicating to a user that, for example, when the structurally-distinguishable mark 320, that is the rib, points towards the user, a terminal which the user sees on the left is a predefined terminal, such as, by way of a non-limiting example, the "start" terminal. Such indication naturally also unambiguously defines the other terminal.

It is appreciated when additional or alternative types of structurally-distinguishable marks are used, other appropriate indications which unambiguously identify the MID terminals may be provided to the user.

FIG. 2G shows a simplified, un-scaled perspective view of the MID 300 of FIG. 2F with layer cuts showing the various layers around the core 310.

FIG. 2H shows a simplified, pictorial illustration of a cross-section view of the MID 300 of FIG. 2F. The cross-section view is an un-scaled view showing the core 310 and layers on a core surface carrying at least one turn of the at least one first winding 340 at a cut A-A shown in FIG. 2F.

It is appreciated that additional types of MIDs may be produced based on the MID 300 with some production modifications and/or by using additional production steps as described below with reference to FIGS. 3A-6N.

Each of the MIDs of FIGS. 3A-6N may comprise at least one of the following cores: a magnetic core; a core comprising at least one insulating material; and an air core comprising a cover for supporting at least one winding. It is appreciated that the cover of the air core may, by way of a non-limiting example, be disposable, so that the cover may, for example, be taken out or consumed by a chemical process after the at least one winding is produced.

Figure 3A:
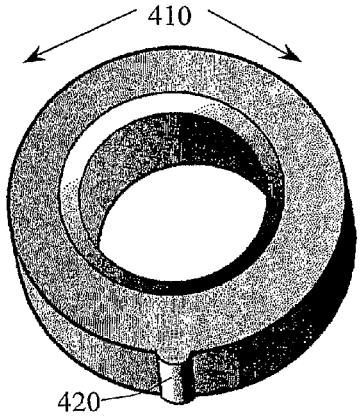
FIGS. 3A-3H together constitute a simplified pictorial illustration of yet another MID comprising a toroidal inductor having an electrically-conductive cover (ECC) in various production stages in accordance with an embodiment of the present invention.
Figure 3B:
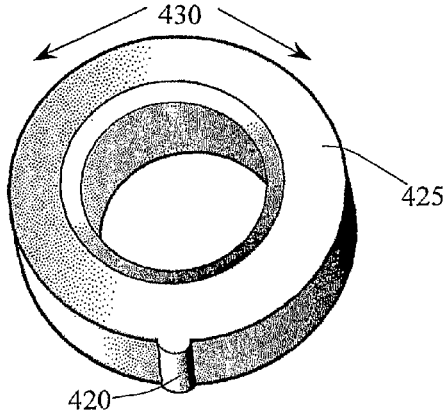
Figure 3C:
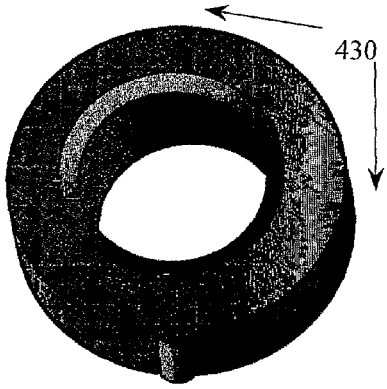
Figure 3D:
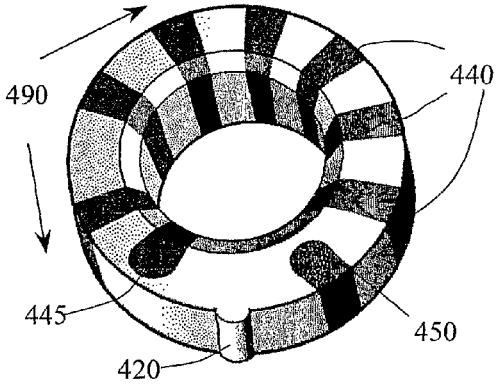
Figure 3E:
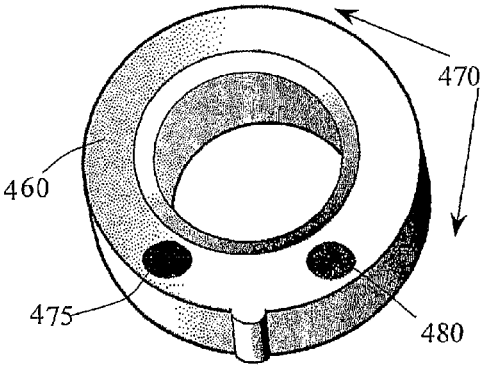
Figure 3F:
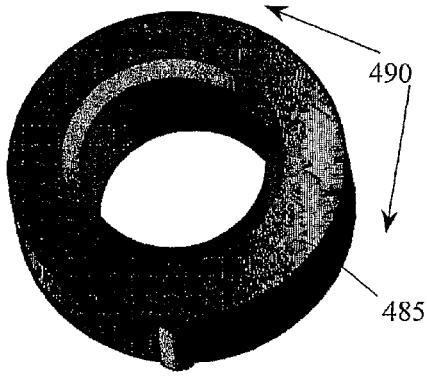
Figure 3G:
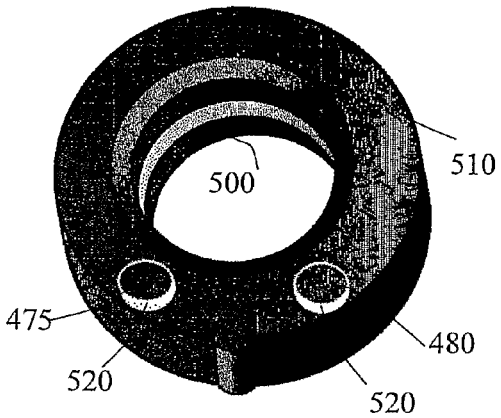
Figure 3H:
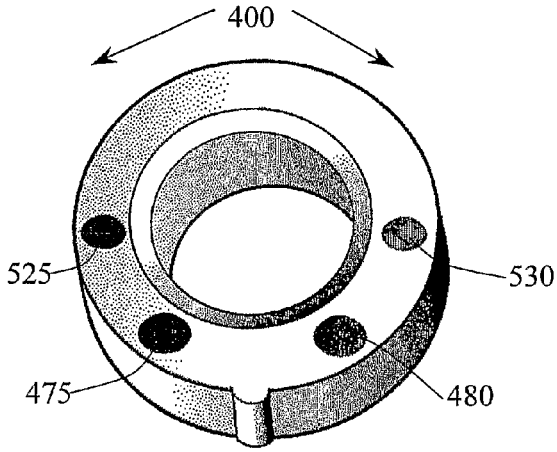
Figure 3I:
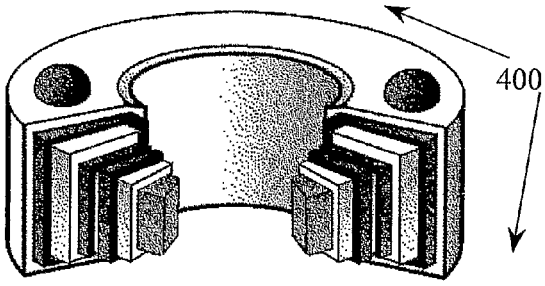
FIG. 3I is a simplified, un-scaled perspective view of the MID of FIG. 3H with layer cuts showing various layers around MID core.

Reference is now additionally made to FIGS. 3A-3H, which together constitute a simplified pictorial illustration of yet another MID 400 comprising a toroidal inductor having an electrically-conductive cover (ECC) in various production stages in accordance with an embodiment of the present invention, and to FIG. 3I which is a simplified, un-scaled perspective view of the MID 400 with layer cuts showing various layers around MID core.

The MID 400 comprises, for example, a toroidal core 410 which comprises, by way of a non-limiting example, a ferrite core. The toroidal core 410 provides a structure which defines a closed path for magnetic flux. It is appreciated that the core 410 may alternatively have another shape, such as, by way of a non-limiting example, a substantially rectangular shape, a substantially polygonal shaped core, or a toroidal shape with an air gap (all not shown).

The core 410 may comprise a structurally-distinguishable mark 420 which may be similar in structure and function to the structurally-distinguishable mark 320 of FIGS. 2A-2F. In the embodiment of FIGS. 3A-3I the structurally-distinguishable mark 420 is shown to comprise, by way of a non-limiting example, a protrusion which comprises a rib.

The core 410 is coated with a dielectric layer 425 to provide a core 430 as shown in FIG. 3B. It is appreciated that coating with the dielectric layer 425 is optional in a case where the core 410 is made of a dielectric material.

The core 430 is prepared for depositing a winding in a few stages. In a first stage, the dielectric layer 425 is etched to improve adhesion between the dielectric layer and a layer to be deposited thereon. The dielectric layer 425 is etched to produce an etched dielectric layer, for example, by dipping the core 430 in a container, which comprises Permanganate Etch Solution Securiganth P.

In a second stage, the etched dielectric layer is neutralized by placing the core 430 in a container comprising a reduction cleaner, such as Reduction Cleaner Securiganth P, to clean residues of permanganate.

In a third stage, the etched and neutralized dielectric layer surface of the core 430 is activated by submersing the core 410 in a palladium tin colloid bath comprising, for example, a MACuplex Activator D-34 activation solution. It is appreciated that palladium serves as a catalyst for deposition of nickel or copper.

In a fourth stage, the core 430 undergoes, after activation, a process of acceleration in which the activated dielectric layer surface of the core 430 is prepared for rapid deposition of a conductive material, such as nickel, by chemical restoration which improves dielectric layer absorption of ion metals. In the acceleration process the core 330 is placed in a container comprising, for example, a Macuplex D-45 solution.

After the stages in which the core 430 is prepared for depositing a winding, at least one first winding 440 is deposited on the core 430. The at least one first winding 440 comprises at least one turn which comprises: an electroless-plated strip of a first conductive material; and an electroplated strip of a second conductive material. The electroplated strip is deposited onto the electroless-plated strip.

The at least one first winding 440 may be deposited on the core 430 to result in a winding which is similar to the at least one first winding 340. By way of a non-limiting example, FIG. 3C shows the core 430 after electroless plating using a chemical deposition technique and after electroplating of copper on the entire surface of the core 430, and FIG. 3D shows a device in which the at least one first winding 440 is obtained after the electroplated copper is selectively etched to produce the at least one first winding 440.

It is appreciated that the at least one first winding 440 may be produced by using a photolithography process in which the core 430 that is coated with a conductive layer is further coated with a photo-resist layer, a mask as shown in FIG. 7 is assembled around the core 430, and the masked core is exposed to multiple ultra-violet (UV) light flashes from different directions and angles so that all core surfaces receive a required amount of UV light. The core 430 may alternatively be placed on a jig, such as the jig shown in FIG. 8, which changes its position in relation to a light source. After exposure to light, portions of the conductive layer are etched to produce the at least one first winding 440.

It is appreciated that the at least one first winding 440 may have a variable width along at least one turn as shown in FIG. 3D. The variable width along the at least one turn may provide better electrical characteristics (e.g., lower resistance) of the at least one turn. For example, if the at least one first winding 440 includes multiple turns, substantially equal distances between adjacent portions of the turns may be maintained while varying the width along each turn so that, for example, a width of a portion of a turn on an outer surface of the core 430 is greater than a width of a portion of the turn on an inner surface of the core 430.

By way of a non-limiting example, the at least one first winding 440 shown in FIG. 3D includes eight turns and terminations 445 and 450, and winding direction is clockwise. It is, however, appreciated that the at least one first winding 440 may alternatively include a different number of turns, and winding direction may alternatively be counter-clockwise.

The core 430 and the at least one first winding 440 may be coated with an insulation layer 460 to provide a device 470 as shown in FIG. 3E. The insulation layer 460 may be similar to the dielectric layer 375 and may be applied similarly to the dielectric layer 375. The insulation layer 460 has through-holes 475 and 480 which match the terminations 445 and 450 of the at least one first winding 440 as shown in FIG. 3E.

The device 470 may then be coated with a conductive layer 485 to provide a device 490 as shown in FIG. 3F. The conductive layer 485 coats the insulation layer 460 and is selectively etched to leave an uncoated gap 500 as shown in FIG. 3G so as to create an electrically-conductive cover (ECC) 510 which does not define a closed conductive path perpendicular to a direction of propagation of magnetic flux in the core 430. The uncoated gap is an electrically insulated gap in the ECC 510 operative so that no closed electrical path of the electrically conductive layer 485 links a closed path of a desired magnetic flux in the device 490.

The ECC 510 may be useful for reducing leakage inductance as described in published PCT application 2006/064499 of Axelrod et al. It is appreciated that in use, the ECC 510 may be connected to a local ground (not shown).

The conductive layer 485 may be deposited on the device 470 by using deposition techniques as used for depositing the conductive layer on the core 430 as shown in FIG. 3C. It is appreciated that when the conductive layer 485 is deposited, the through-holes 475 and 480 are at least partially filled with the conductive material, and areas 520 surrounding the through-holes are then etched to isolate terminals of the at least one first winding 440 from the ECC 510.

The device of FIG. 3G may also be coated on all of its surfaces with an additional insulation layer except for the terminals 475 and 480 as shown in FIG. 3H to provide the MID 400. Additionally, through-holes 525 and 530 may be drilled through the additional insulation layer and may be at least partially filled with conductive material, such as silver-epoxy, to provide terminations for enabling connection of the ECC 510 to a local ground. It is appreciated that the MID 400 may be used as a one-layer toroidal inductor with an ECC.

FIG. 3I shows a simplified, un-scaled perspective view of the MID 400 with layer cuts showing the various layers around the core 410.

Figure 4A:
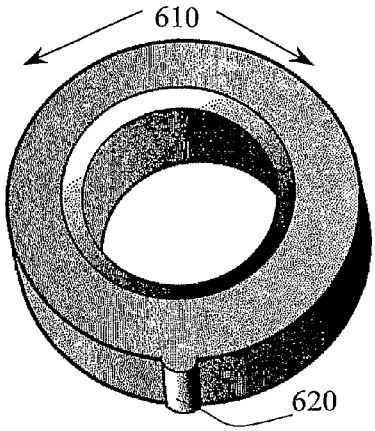
FIGS. 4A-4J together constitute a simplified pictorial illustration of still another MID comprising a toroidal inductor in various production stages in accordance with an embodiment of the present invention.
Figure 4B:
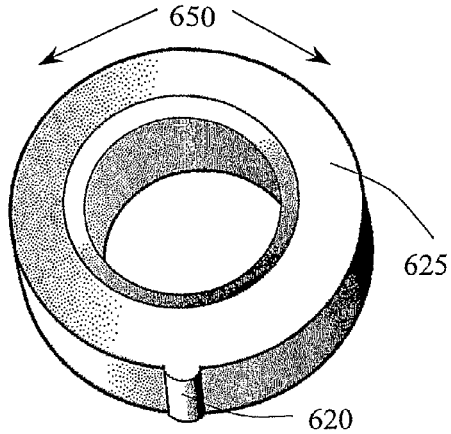
Figure 4C:
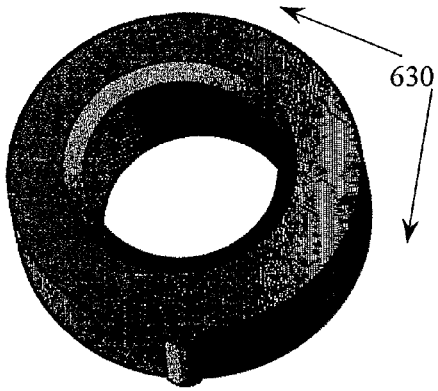
Figure 4D:
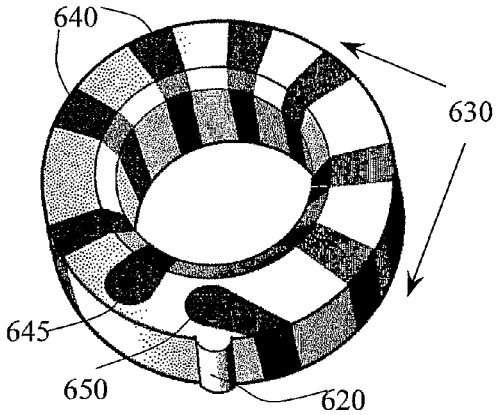
Figure 4E:
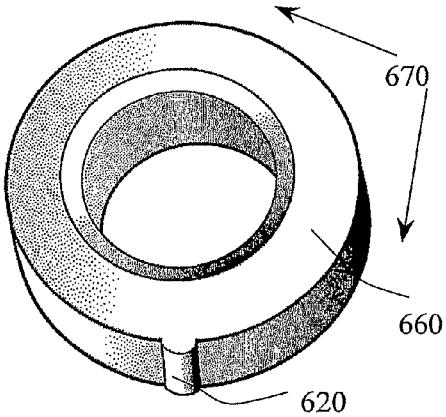
Figure 4F:
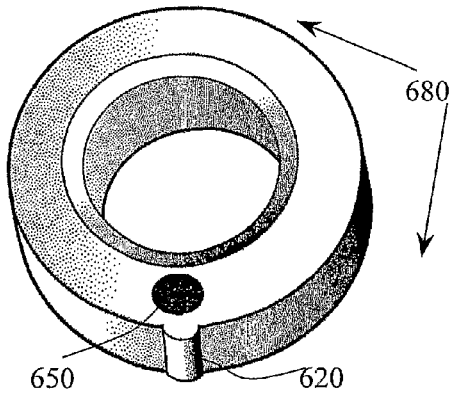
Figure 4G:
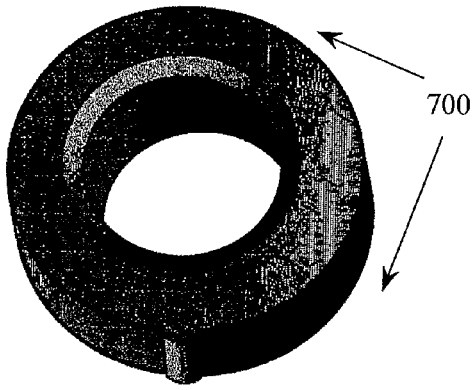
Figure 4H:
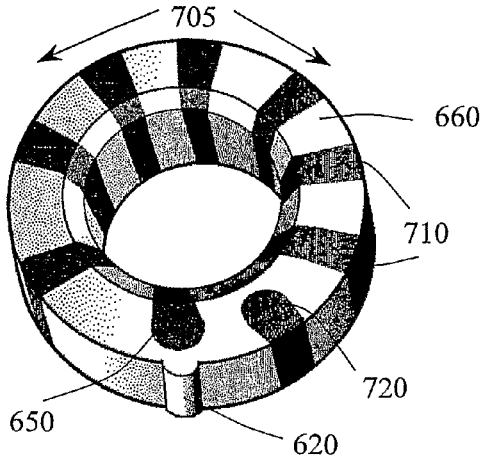
Figure 4I:
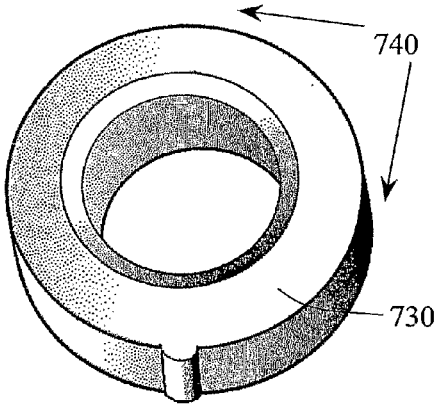
Figure 4J:
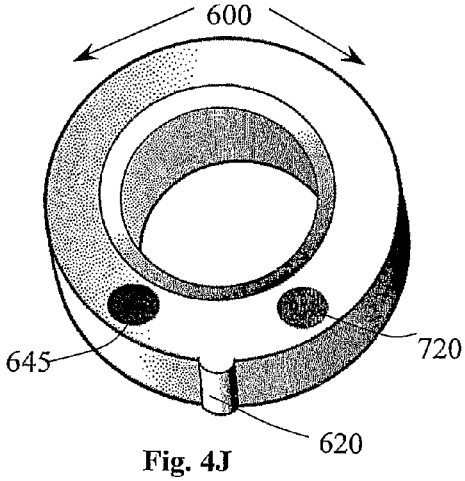
Figure 4K:
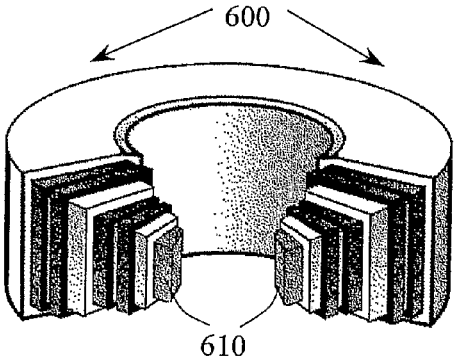
FIG. 4K is a simplified, un-scaled perspective view of the MID of FIG. 4J with layer cuts showing various layers around MID core.

Reference is now additionally made to FIGS. 4A-4J, which together constitute a simplified pictorial illustration of still another MID 600 comprising a toroidal inductor in various production stages in accordance with an embodiment of the present invention, and to FIG. 4K which is a simplified, un-scaled perspective view of the MID 600 with layer cuts showing various layers around MID core.

The MID 600 comprises, for example, a toroidal core 610 which comprises, by way of a non-limiting example, a ferrite core and is similar to the core 410 and has a structurally-distinguishable mark 620 which may be similar in structure and function to the structurally-distinguishable mark 420. The toroidal core 610 provides a structure which defines a closed path for magnetic flux. It is appreciated that the core 610 may alternatively have another shape, such as, by way of a non-limiting example, a substantially rectangular shape, a substantially polygonal shaped core, or a toroidal shape with an air gap (all not shown).

The core 610 is coated with a dielectric layer 625 to provide a core 630 as shown in FIG. 3B.

The core 630 may be prepared for depositing a winding similarly to the core 430, and at least one first winding 640 may be deposited on the core 630 similarly to the at least one first winding 440 by using similar deposition techniques for depositing a conductive layer, and by etching the conductive layer to produce the at least one first winding 640. By way of a non-limiting example, the at least one first winding 640 in FIG. 4D includes eight turns and terminations 645 and 650, and winding direction is clockwise. It is, however, appreciated that the at least one first winding 640 may alternatively include a different number of turns, and winding direction may alternatively be counterclockwise.

It is appreciated that the at least one first winding 640 may have a variable width along at least one turn as shown in FIG. 4D. The variable width along the at least one turn may provide better electrical characteristics (e.g., lower resistance) of the at least one turn as described above, for example, with reference to FIGS. 2A-2H.

The core 630 is coated on all of its surfaces with an insulation layer 660 to provide a device 670 as shown in FIG. 4E. Then, the termination 650 may be exposed, for example, by using a laser to drill a hole through a portion of the insulation layer 660 which covers the termination 650. The hole may then be at least partially filled with a conductive material, such as copper, to provide a device 680 as shown in FIG. 4F. It is appreciated that location of an area for drilling the hole is enabled by using the structurally-distinguishable mark 620 as a reference point for positioning the laser.

The device 680 of FIG. 4F is coated with a copper layer to obtain a device 700 as depicted in FIG. 4G, and the copper layer is etched to provide a device 705 as shown in FIG. 4H. The copper layer is etched to form at least one second winding 710 above at least a portion of the insulation layer 660. By way of a non-limiting example, the at least one second winding 710 in FIG. 4H also includes eight turns and winding direction is also clockwise.

It is appreciated that the at least one first winding 640 is electrically connected to the at least one second winding 710 via the termination 650. The at least one second winding 710 includes a termination 720.

The device 705 may also be coated on all of its surfaces with an insulation layer 730 to provide a device 740 as shown in FIG. 4I. Then, using the structurally-distinguishable mark 620 as a reference point, the terminations 645 and 720 may be exposed by using laser drilling for drilling holes as mentioned above with reference to the termination 650. The holes which reach the terminations 645 and 720 have different depths because the terminations 645 and 720 are at different layers. The holes may be at least partially filled with a conductive material, such as copper, to provide the MID 600 as shown in FIG. 4J with conductive terminations 645 and 720. It is appreciated that the MID 600 may be used as a two-layer toroidal inductor.

FIG. 4K shows a simplified, un-scaled perspective view of the MID 600 with layer cuts showing the various layers around the core 610.

Figure 5A:
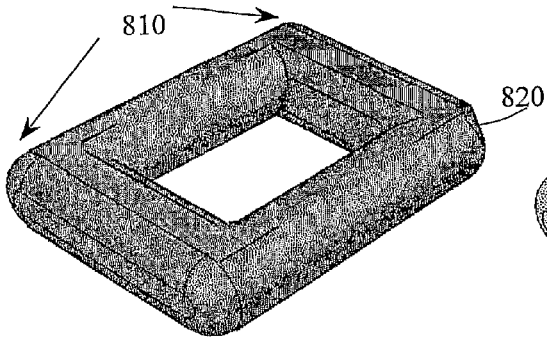
FIGS. 5A-5F together constitute a simplified pictorial illustration of yet another MID comprising a transformer in various production stages in accordance with an embodiment of the present invention.
Figure 5B:
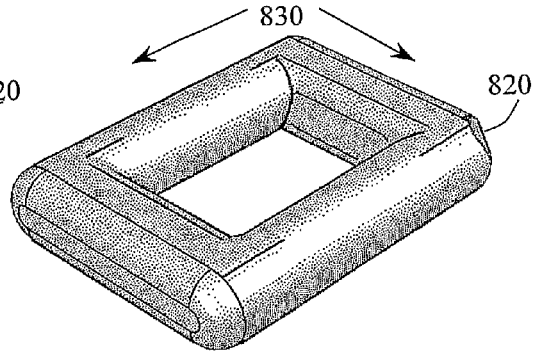
Figure 5C:
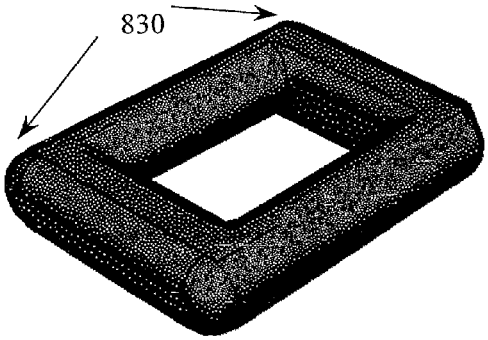
Figure 5D:
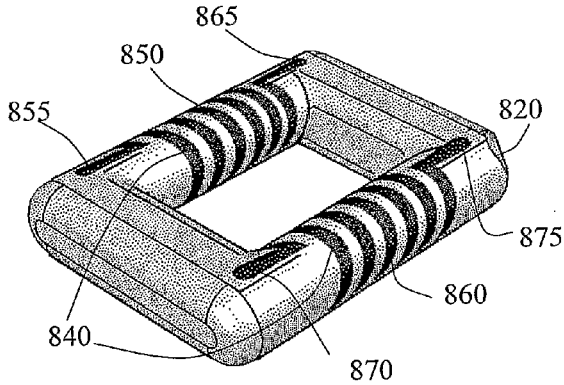
Figure 5E:
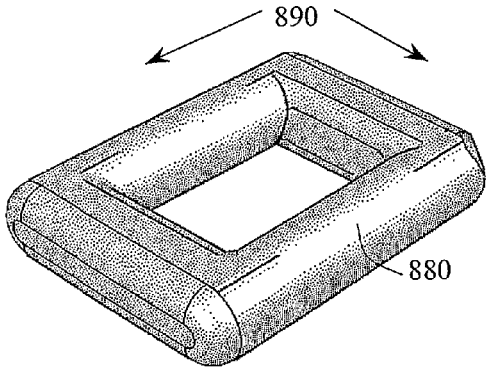
Figure 5F:
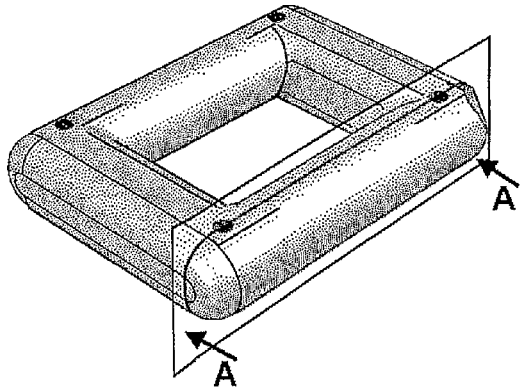
Figure 5G:
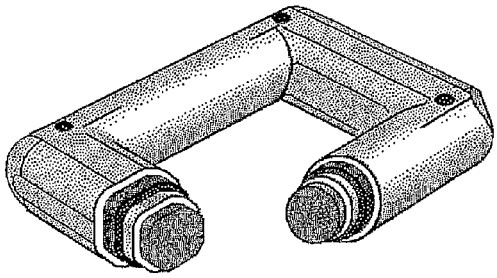
FIG. 5G is a simplified, un-scaled perspective view of the MID of FIG. 5F with layer cuts showing various layers around MID core.
Figure 5H:
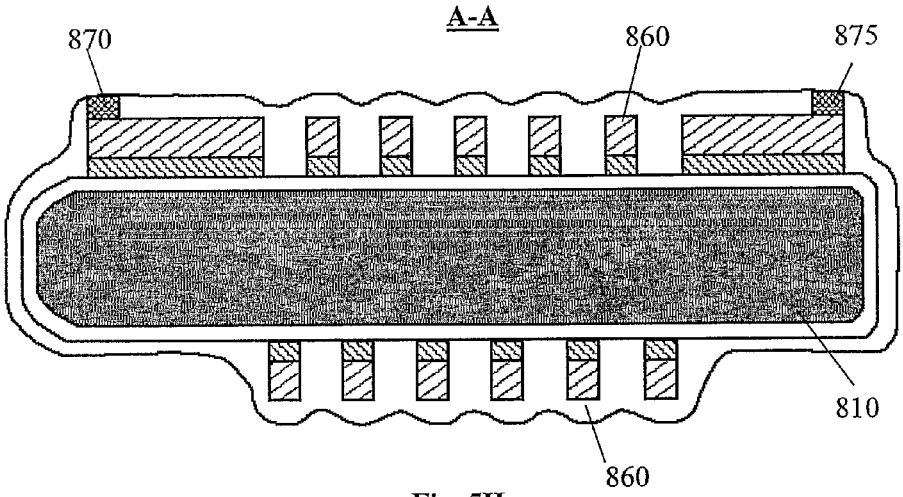
FIG. 5H is a simplified pictorial illustration of a cross-section view of the MID of FIG. 5F.

Reference is now additionally made to FIGS. 5A-5H, which together constitute a simplified pictorial illustration of yet another MID 800 comprising a transformer in various production stages in accordance with an embodiment of the present invention, to FIG. 5G which is a simplified, un-scaled perspective view of the MID 800 with layer cuts showing various layers around MID core, and to FIG. 5H which is a simplified pictorial illustration of a cross-section view of the MID 800.

The MID 800 comprises, for example, a core 810 which comprises, by way of a non-limiting example, a ferrite core. The core 810 has a substantially rectangular shape with a structure which comprises a bar frame comprising at least one substantially straight bar. By way of a non-limiting example, in the embodiment of FIGS. 5A-5H, the core 810 has four bars, and all four bars of the bar frame are substantially straight bars with two of the bars which are opposite to each other being cylindrically shaped and the other two bars having a substantially rectangular shape. The core 810 provides a structure which defines a closed path for magnetic flux.

The core 810 has a structurally-distinguishable mark which may comprise, by way of a non-limiting example, a rounded corner 820 of the core 810.

The core 810 is coated with a dielectric layer 825 to provide a core 830 as shown in FIG. 5B.

The core 830 may be prepared for depositing a winding similarly to the core 430, and at least one first winding 840 may be deposited on the core 830 similarly to the at least one first winding 440 by using similar deposition techniques for depositing a conductive layer, and by etching the conductive layer to produce the at least one first winding 840. However, in the embodiment of FIGS. 5A-5H, the at least one first winding 840 is deposited, by way of a non-limiting example, only on the two cylindrical bars as shown in FIG. 5D thus forming two separate windings 850 and 860. Thus, in a case where the at least one first winding 840 is formed by electroless plating and electroplating, an electroless-plated strip and an electroplated strip are deposited on the two cylindrical bars to provide the windings 850 and 860, and in a case where a conductive layer is deposited on the entire core 810 as shown in FIG. 5C, the conductive layer is selectively etched on the two cylindrical bars and entirely etched on the two other bars to provide the windings 850 and 860. By way of a non-limiting example, the winding 850 in FIG. 5D includes six turns and one pair of terminations comprising terminations 855 and 865, the winding 860 in FIG. 5D includes six turns and one pair of terminations comprising terminations 870 and 875, and winding direction in each of the windings 850 and 860 is clockwise.

The device 830 may be coated on all of its surfaces with an insulation layer 880 to provide a device 890 as shown in FIG. 5E, and the terminations 855, 865, 870 and 875 may be exposed, for example, by using a laser to drill holes through portions of the insulation layer 880 which cover the terminations 855, 865, 870 and 875. The holes may then be at least partially filled with a conductive material, such as copper, to provide the MID 800 as shown in FIG. 5F which may be used as a transformer, with the terminations 855, 865, 870 and 875 being used as transformer terminals, and the transformer being capable of use as a surface-mount device (SMD). It is appreciated that identification of the SMT device terminals is done by using the structurally-distinguishable mark 820 as a reference point.

FIG. 5G shows a simplified, un-scaled perspective view of the MID 800 with layer cuts showing the various layers around the core 810.

FIG. 5H shows a simplified, pictorial illustration of a longitudinal section view of the MID 800. The longitudinal section view is an un-scaled view showing the core 810 and layers on a core surface carrying the six turns of the at least one first winding 840 along a cut A-A shown in FIG. 5F.

It is further appreciated that in a case where thick copper strips are desired, the thick copper strips may be produced by using electroforming techniques.

Figure 6A:
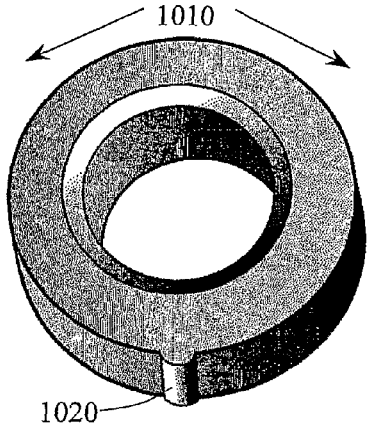
FIGS. 6A-6L together constitute a simplified pictorial illustration of still another MID comprising a toroidal transformer having an ECC in various production stages in accordance with an embodiment of the present invention.
Figure 6B:
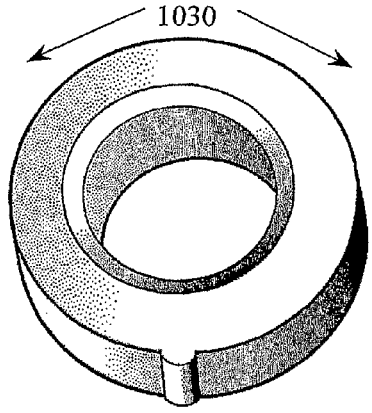
Figure 6C:
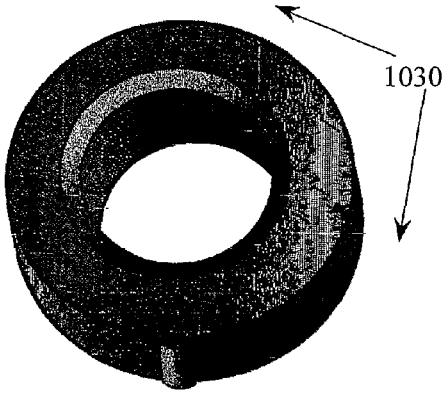
Figure 6D:
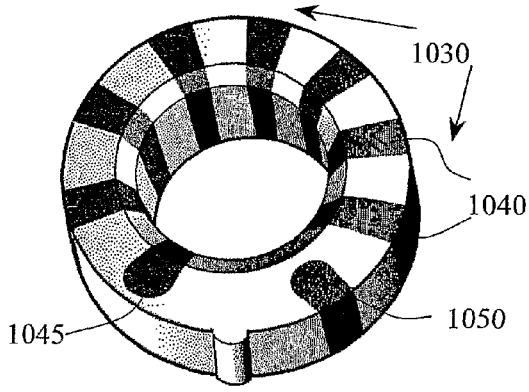
Figure 6E:
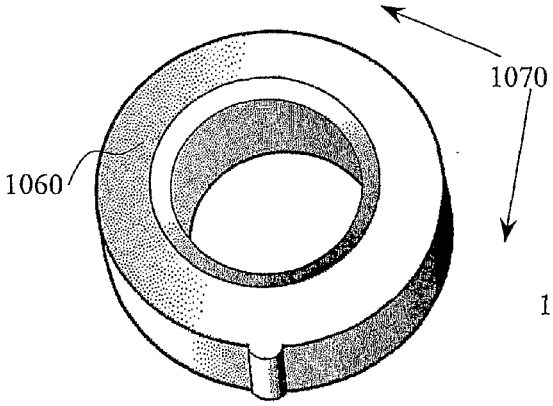
Figure 6F:
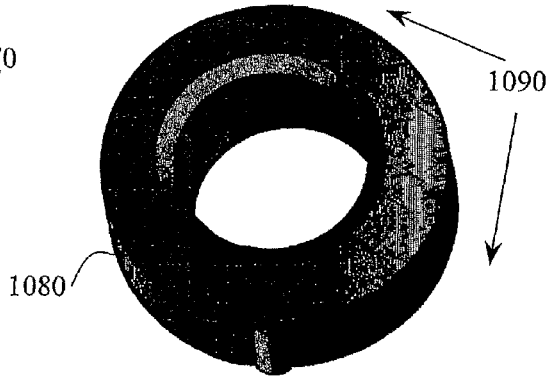
Figure 6G:
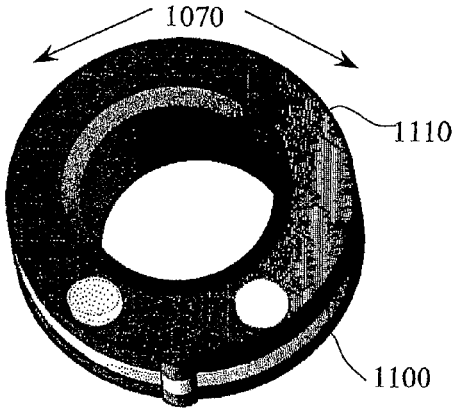
Figure 6H:
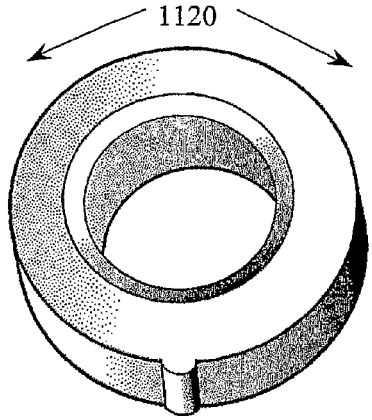
Figure 6I:
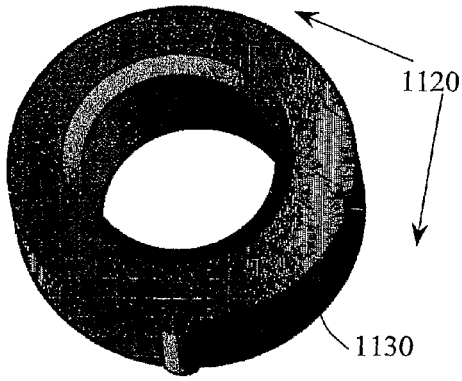
Figure 6J:
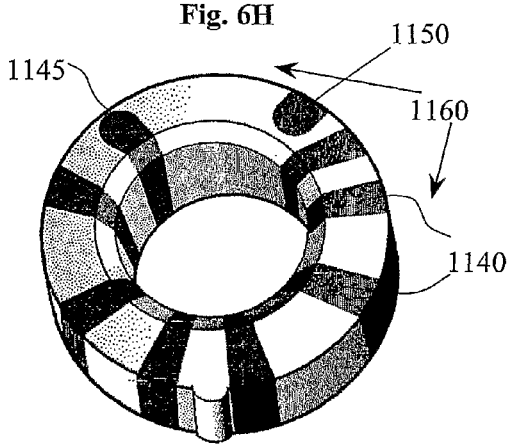
Figure 6K:
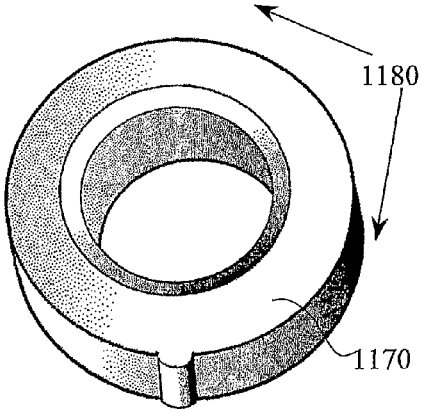
Figure 6L:
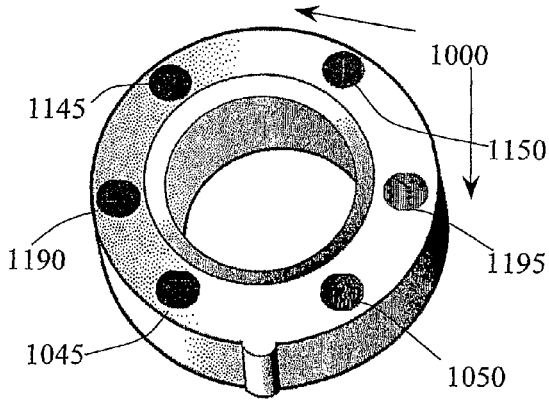
Figure 6M:
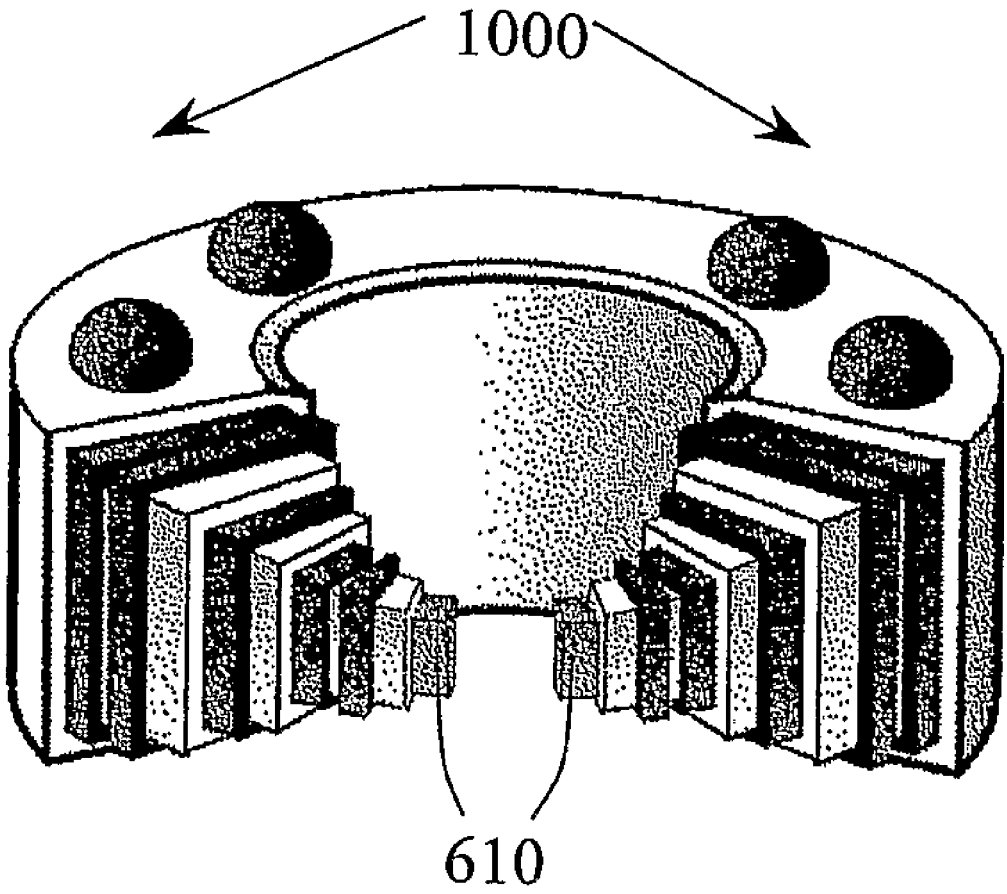
FIG. 6M is a simplified, un-scaled perspective view of the MID of FIG. 6L with layer cuts showing various layers around MID core.

Reference is now additionally made to FIGS. 6A-6L, which together constitute a simplified pictorial illustration of still another MID 1000 comprising a toroidal transformer having an ECC in various production stages in accordance with an embodiment of the present invention, and to FIG. 6M which is a simplified, un-sealed perspective view of the MID 1000 with layer cuts showing various layers around MID core.

The MID 1000 comprises, for example, a toroidal core 1010 which comprises, by way of a non-limiting example, a ferrite core and is similar to the core 410 and has a structurally-distinguishable mark 1020 which may be similar in structure and function to the structurally-distinguishable mark 420. The toroidal core 1010 provides a structure which defines a closed path for magnetic flux. It is appreciated that the core 1010 may alternatively have another shape, such as, by way of a non-limiting example, a substantially rectangular shape, a substantially polygonal shaped core, or a toroidal shape with an air gap (all not shown).

The core 1010 is coated with a dielectric layer 1025 to provide a core 1030 as shown in FIG. 3B.

The core 1030 may be prepared for depositing a winding similarly to the core 430, and at least one first winding 1040 may be deposited on the core 1030 similarly to the at least one first winding 440 by using similar deposition techniques for depositing a conductive layer, and by etching the conductive layer to produce the at least one first winding 1040. Alternatively a conductive strip may be constructed to produce the at least one first winding 1040. By way of a non-limiting example, the at least one first winding 1040 in FIG. 6D includes eight turns and terminations 1045 and 1050, and winding direction is clockwise. It is, however, appreciated that the at least one first winding 1040 may alternatively include a different number of turns, and winding direction may alternatively be counterclockwise.

It is appreciated that the at least one first winding 1040 may have a variable width along at least one turn as shown in FIG. 6D. The variable width along the at least one turn may provide better electrical characteristics of the at least one turn as described above, for example, with reference to FIGS. 2A-2H.

The core 1030 is coated on all of its surfaces with an insulation layer 1060 to provide a device 1070 as shown in FIG. 6E, and the device 1070 is coated with a conductive layer 1080 to provide a device 1090 as shown in FIG. 6F. The conductive layer 1080 coats the insulation layer 1060 and is selectively etched to leave an uncoated gap 1100 as shown in FIG. 6G so as to create an electrically-conductive cover (ECC) 1110 which does not define a closed conductive path perpendicular to a direction of propagation of magnetic flux in the core 1030. The ECC 1110 may be connected to a local ground (not shown).

The conductive layer 1080 may be deposited on the device 1070 by using deposition techniques as used for depositing the at least one first winding 440. After depositing the conductive layer 1080, area 1100 is etched to construct the gap (e.g., by laser), and areas above the terminals 1045 and 1050 are etched to isolate terminals from connecting to the ECC 1110.

The device of FIG. 6G may be coated on all of its surfaces with an additional insulation layer to provide a device 1120 as shown in FIG. 6H. The device 1120 is then coated with an additional conductive layer 1130 as shown in FIG. 6I, and the conductive layer 1130 is etched to form at least one second winding 1140 including terminations 1145 and 1150 and to provide a device 1160 as shown in FIG. 6J. By way of a non-limiting example, the at least one second winding 1140 includes eight turns and winding direction is clockwise.

The device 1160 may also be coated on all of its surfaces with an insulation layer 1170 to provide a device 1180 as shown in FIG. 6K. Then, the terminations 1045, 1050, 1145, and 1150 may be exposed, for example, by using a laser to drill holes through portions of the layers which cover the terminations 1045, 1050, 1145, and 1150. Additionally, holes are also drilled through portions of the layers which cover the ECC 1110 so as create terminations 1190 and 1195 for the ECC 1110. The holes may then be at least partially filled with a conductive material, such as copper, to provide the MID 1000 as shown in FIG. 6L which may be used as a transformer, with the terminations 1045, 1050, 1145, and 1150 being used as transformer terminals and the terminations 1190 and 1195 used as terminals for connecting the ECC 1110 to a local ground. It is appreciated that identification of the terminals is enabled by using the structurally-distinguishable mark 1020 as a reference point.

FIG. 6M shows a simplified, un-scaled perspective view of the MID 1000 with layer cuts showing the various layers around the core 1010.

Reference is now made to FIG. 7, which is a simplified pictorial illustration of a mask 1500 usable in production of a MID in accordance with an embodiment of the present invention.

The mask 1500 comprises a three-dimensional mask having a part 1510 and a part 1520 which may be used to cover a core 1530, from above and under the core 1530. The core 1530 may comprise any of the cores of FIGS. 2A-4K and 6A-6M with or without layers deposited thereon.

The mask 1500 may be used in a physical deposition process for depositing conductive material on the core 1530 contained in the mask 1500 through openings in the mask 1500. The material deposited on the core 1530 takes the form of the openings thus resulting in conductive strips which are deposited on the core 1530.

The mask 1500 may also be used in a photolithography process. In such a case, the core 1530 is coated with a conductive layer and then with a photo-resist layer, the mask 1530 is assembled around the core 1530, and the masked core is illuminated by multiple ultra-violet (UV) light flashes from different directions and angles so that all core surfaces receive a required amount of UV light. The core 1530 may alternatively be placed on a jig, such as the jig shown in FIG. 8, which changes its position in relation to a UV light source.

After exposure to light, portions of the conductive layer are etched to produce a winding.

It is appreciated that an alternative mask construction (not shown) may be used for a photolithography process. The alternative mask construction may comprise at least two two-dimensional mask elements, one of which to be positioned above the core 1530 and the other to be positioned below the core 1530, with at least one of the mask elements being larger in size than the core. Exposure to the light source is performed through the mask, with UV illumination being carried out vertically from above the core and below the core, as well as at appropriate inclination angles and positions around the core 1530.

Figure 8:
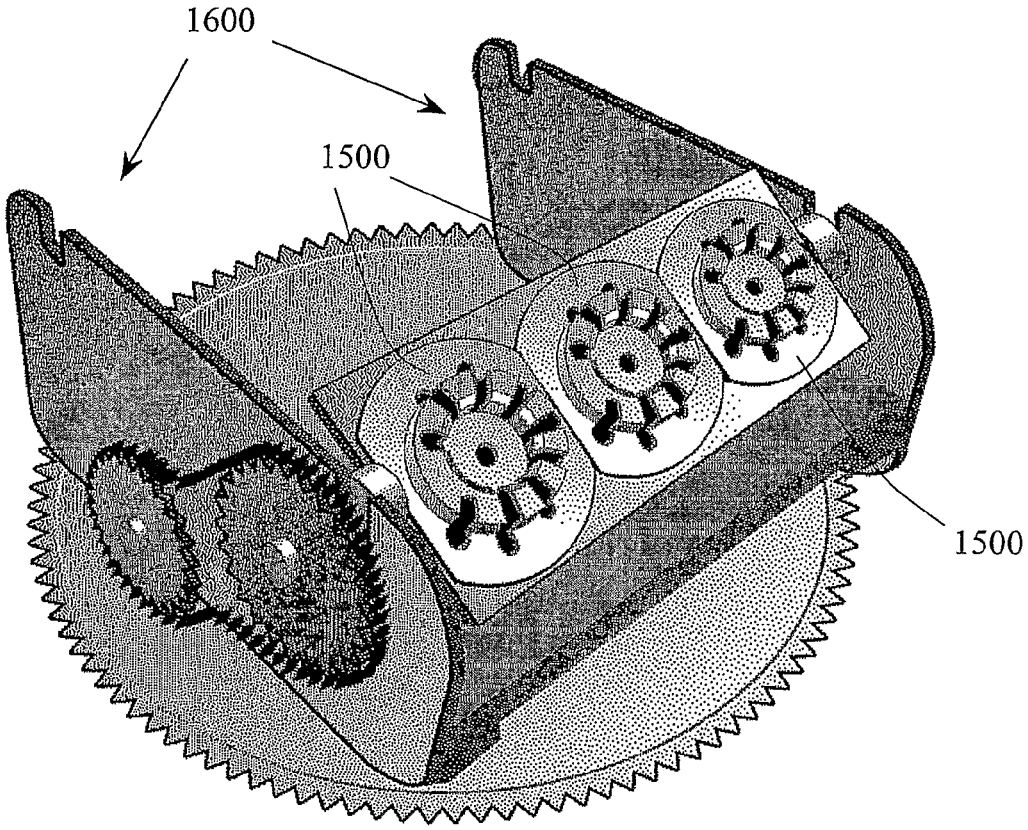
FIG. 8 is a simplified pictorial illustration of a jig usable for positioning and holding the mask of FIG. 7, or a plurality thereof, in accordance with an embodiment of the present invention.

Reference is now additionally made to FIG. 8, which is a simplified pictorial illustration of a jig 1600 usable for positioning and holding the mask 1500, or a plurality thereof, in accordance with an embodiment of the present invention.

The jig 1600 is capable of rotating in two or three dimensions. The jig 1600 may position and hold the mask 1500, or a plurality thereof, while containing a core or a plurality of cores in a thin-film deposition chamber (not shown).

Figure 9:
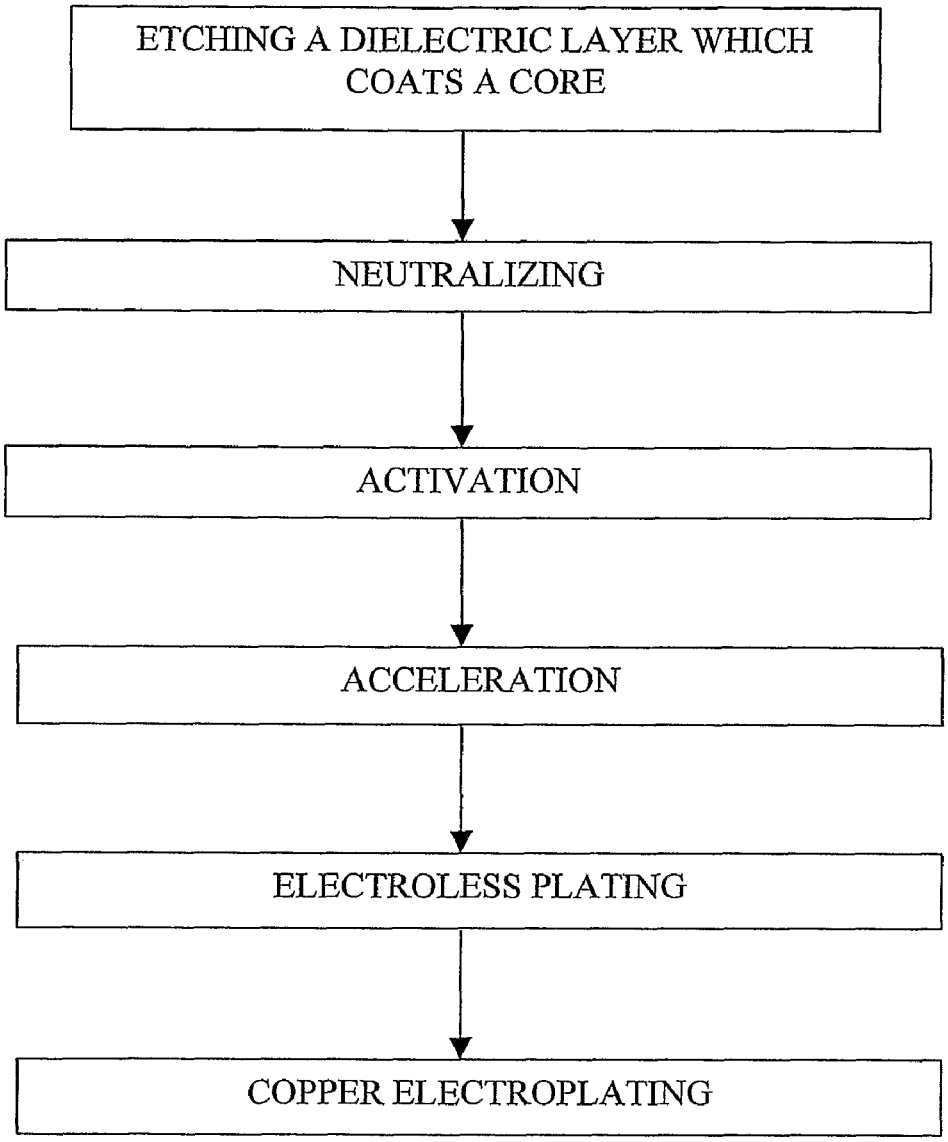
FIG. 9 is a simplified flowchart illustration of a method for depositing a conductive layer on a core coated with a dielectric layer.

Reference is now made to FIG. 9, which is a simplified flowchart illustration of a method for depositing a conductive layer on a core coated with a dielectric layer. The method of FIG. 9 is self-explanatory.

Figure 10:
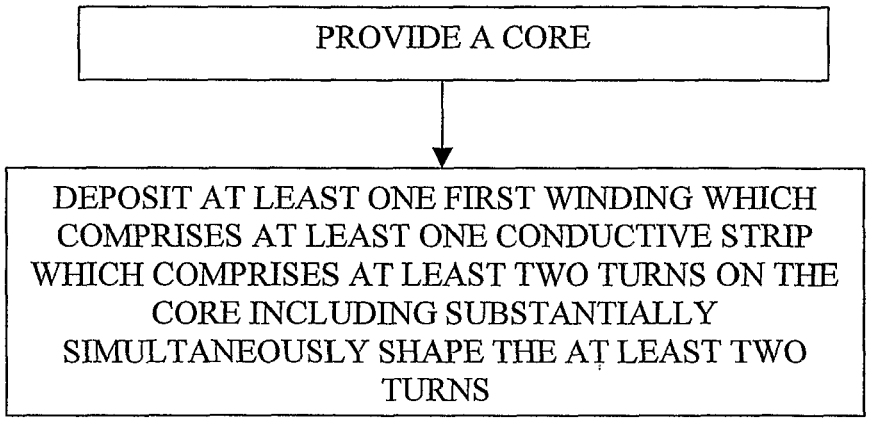
FIG. 10 is a simplified flowchart illustration of a method for producing any of the MIDs of FIGS. 2A-6M.

Reference is now made to FIG. 10, which is a simplified flowchart illustration of a method for producing any of the MIDs of FIGS. 2A-6M. The method of FIG. 10 is self-explanatory.

Figure 11:
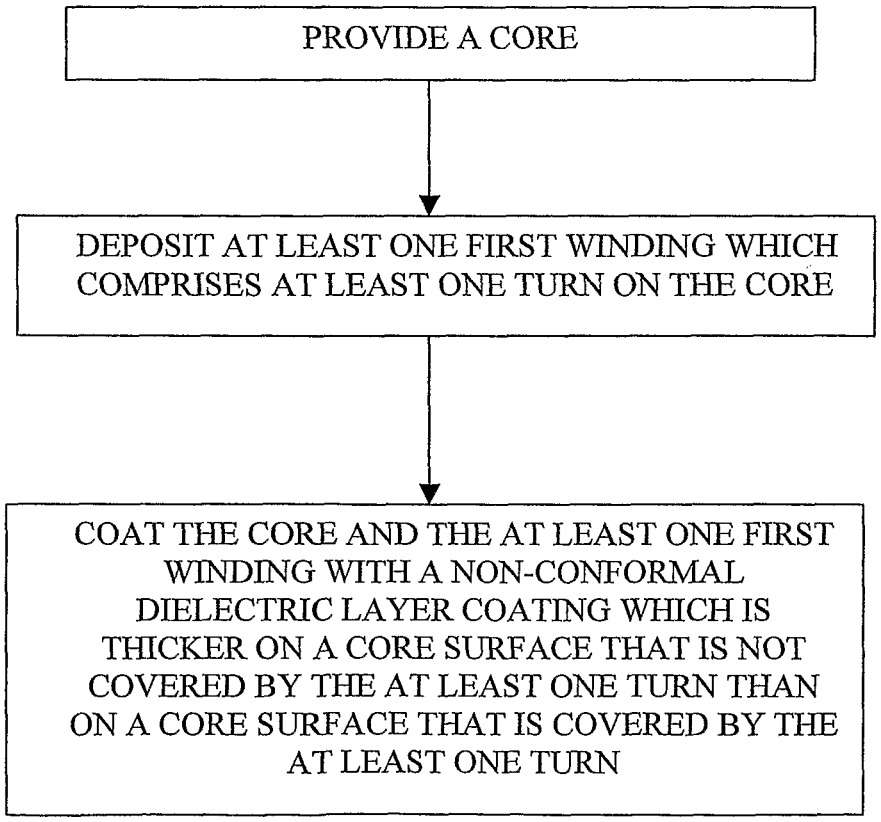
FIG. 11 is a simplified flowchart illustration of another method for producing any of the MIDs of FIGS. 2A-6M.

Reference is now made to FIG. 11, which is a simplified flowchart illustration of another method for producing any of the MIDs of FIGS. 2A-6M. The method of FIG. 11 is self-explanatory.

Figure 12:
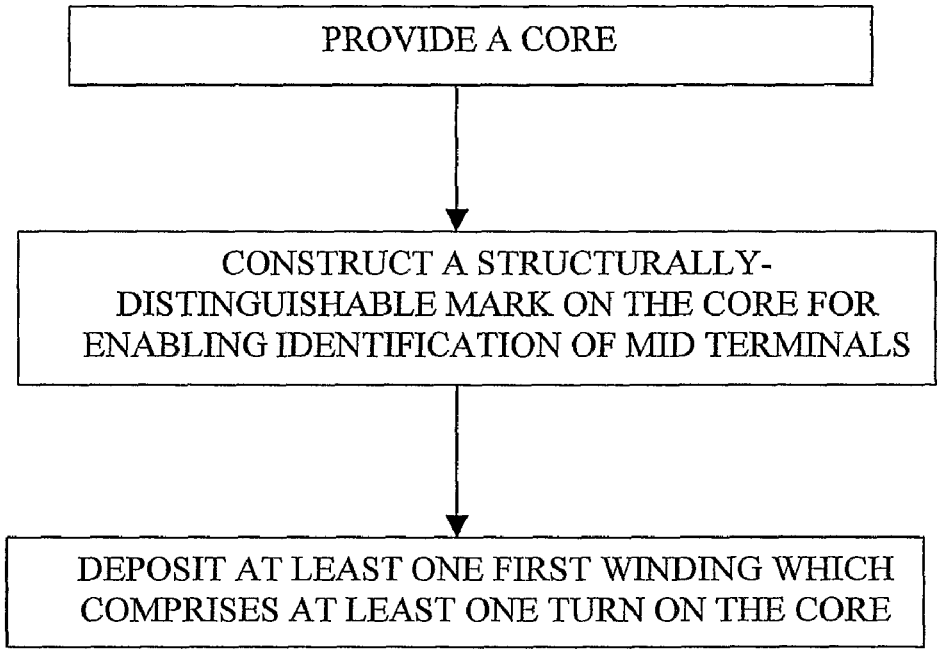
FIG. 12 is a simplified flowchart illustration of yet another method for producing any of the MIDs of FIGS. 2A-6M.

Reference is now made to FIG. 12, which is a simplified flowchart illustration of yet another method for producing any of the MIDs of FIGS. 2A-6M. The method of FIG. 12 is self-explanatory.

Figure 13:
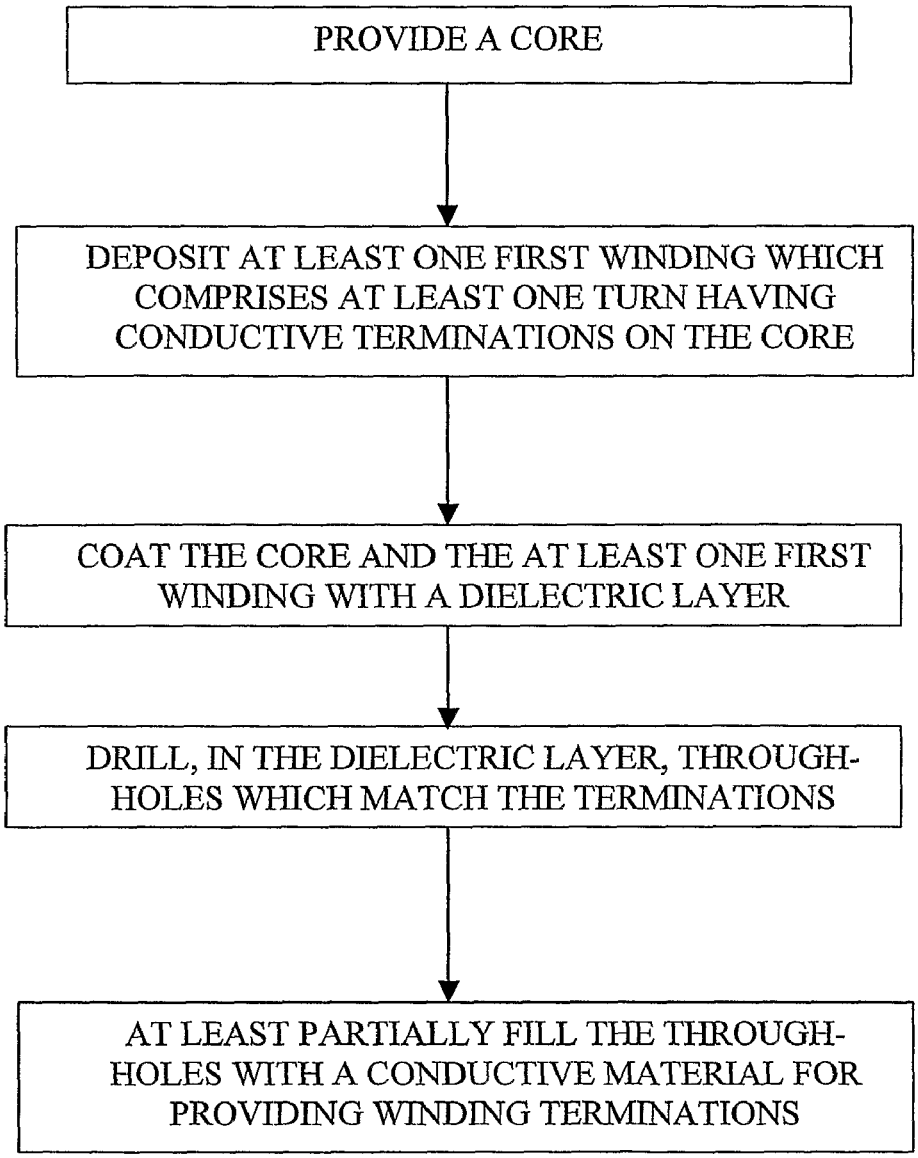
FIG. 13 is a simplified flowchart illustration of still another method for producing any of the MIDs of FIGS. 2A-6M.

Reference is now made to FIG. 13, which is a simplified flowchart illustration of still another method for producing any of the MIDs of FIGS. 2A-6M. The method of FIG. 13 is self-explanatory.

It is appreciated that MID production as described above takes cores as its basis and is thus suitable for production of MIDs with cores made of a variety of materials and having various core shapes and various core dimensions. Additionally, MID production as described above is suitable for producing MIDs with different numbers of copper layers, different numbers of windings in each layer, different numbers of turns in windings, different densities of turns in windings, different shapes and widths of winding strips, different numbers and positions of ECC layers, etc. MID production as mentioned above is also suitable for producing MIDs in which different winding techniques are used.

MID production as described above offers novel winding structures and methods for constructing such structures around cores.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable sub-combination.

It will be appreciated by persons skilled in the art that the present invention is not limited by what has been particularly shown and described hereinabove. Rather the scope of the invention is defined by the appended claims and their equivalents:

What is claimed is:

1. A magnetic induction device (MID) comprising:

a magnetic core having a structure which defines a closed path for magnetic flux around a hollow portion;

at least one first winding formed by depositing at least two turns in their entirety on the magnetic core;

an insulation layer which coats the magnetic core and the at least one first winding and has a plurality of through-holes which are at least partially filled with a conductive material; and at least one second winding formed by depositing at least two turns in their entirety on at least a portion of the insulation layer.

2. The MID according to claim 1, further comprising:

a conductive layer electrically isolated from the at least one first winding and from the at least one second winding and selectively etched/constructed to leave an uncoated gap so as to create an electrically-conductive cover (ECC) which does not define a closed conductive path perpendicular to a direction of propagation of magnetic flux in the magnetic core, the ECC being placed between the at least one first winding and the at least one second winding.

3. The MID according to claim 1, further comprising:

a conductive layer electrically isolated from the at least one first winding and from the at least one second winding and selectively etched/constructed to leave an uncoated gap so as to create an electrically-conductive cover (ECC) which does not define a closed conductive path perpendicular to a direction of propagation of magnetic flux in the magnetic core, the ECC being placed on the at least one second winding.

4. The MID according to claim 1, wherein the insulation layer comprises a non-conformal dielectric layer.

5. The MID according to claim 4, wherein the non-conformal dielectric layer is thicker on a core surface that is not covered by a turn of the at least one first winding than on a core surface that is covered by a turn of the at least one first winding so as to obtain a substantially flattened surface area of the non-conformal dielectric layer.

6. The MID according to claim 1, wherein each of the at least one first winding and the at least one second winding comprises at least one pair of terminations enabling the MID to operate as a transformer.

7. The MID according to claim 1, further comprising a surface-mount device (SMD).

8. The MID according to claim 1, further comprising a dielectric layer which coats the magnetic core under the at least one first winding.

9. A method of producing a magnetic induction device (MID), the method comprising:

providing a magnetic core having a structure which defines a closed path for magnetic flux around a hollow portion;

forming at least one first winding by depositing at least two turns in their entirety on the magnetic core;

coating the magnetic core and the at least one first winding with a first insulation layer;

forming at least one second winding by depositing at least two turns in their entirety on at least a portion of the first insulation layer;

coating the first insulation layer and the at least one second winding with a second insulation layer;

forming a plurality of through-holes, the forming a plurality of through-holes comprising forming each of the through-holes in at least one of the first insulation layer and the second insulation layer; and at least partially filling the through-holes with a conductive material.

10. The method according to claim 9, further comprising:

using at least one of the through-holes which is at least partially filled with the conductive material to enable electrical conductivity between the at least one first winding and the at least one second winding.

11. The method according to claim 9, wherein the forming at least one first winding comprises:

selectively etching a layer obtained using a photolithography technique.

12. The method according to claim 11, wherein the forming at least one second winding comprises:

selectively etching a layer obtained using a photolithography technique.

13. The method according to claim 9, further comprising:

creating an electrically-conductive cover (ECC) which does not define a closed conductive path perpendicular to a direction of propagation of magnetic flux in the magnetic core and is electrically isolated from the at least one first winding and from the at least one second winding, the creating comprising creating the ECC between the at least one first winding and the at least one second winding.

14. The method according to claim 9, further comprising:

creating an electrically-conductive cover (ECC) which does not define a closed conductive path perpendicular to a direction of propagation of magnetic flux in the magnetic core and is electrically isolated from the at least one first winding and from the at least one second winding, the creating comprising creating the ECC on the at least one second winding.

15. A method of producing a magnetic induction device (MID), the method comprising:

providing a magnetic core having a structure which defines a closed path for magnetic flux around a hollow portion;

depositing at least one first winding on the magnetic core, the depositing comprising selectively etching a layer obtained using a photolithography technique to form at least two turns in their entirety on the magnetic core;

coating the magnetic core and the at least one first winding with an insulation layer;

forming a plurality of through-holes in the insulation layer; and at least partially filling the through-holes with a conductive material to form terminals.

* * * * *

UNITED STATES PATENT AND TRADEMARK OFFICE

CERTIFICATE OF CORRECTION

PATENT NO. : 8,106,739 B2
APPLICATION NO. : 12/663844
DATED : January 31, 2012
INVENTOR(S) : Zeev Shpiro It is certified that error appears in the above-identified patent and that said Letters Patent is hereby corrected as shown below:

Front page

(73) should be corrected as follows:
change
--Advanced Magnetic Solutions United,--
to
"Advanced Magnetic Solutions Limited,"

Signed and Sealed this
Twenty-seventh Day of March, 2012

David J. Kappos

David J. Kappos
*Director of the United States Patent and Trademark Office*